US009199268B2

(12) United States Patent
Yamamoto et al.

(10) Patent No.: US 9,199,268 B2
(45) Date of Patent: Dec. 1, 2015

(54) CURTAIN COATING METHOD AND CURTAIN COATING DEVICE

(75) Inventors: Kazuhisa Yamamoto, Shizuoka (JP); Hiroki Somada, Shizuoka (JP); Tetsuya Hara, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 343 days.

(21) Appl. No.: 13/433,530

(22) Filed: Mar. 29, 2012

(65) Prior Publication Data

US 2012/0251731 A1 Oct. 4, 2012

(30) Foreign Application Priority Data

Mar. 31, 2011 (JP) ..... 2011-080197

(51) Int. Cl.
*B05D 1/30* (2006.01)
*B05C 5/00* (2006.01)
*B05B 15/02* (2006.01)

(52) U.S. Cl.
CPC ..... *B05D 1/305* (2013.01); *B05B 15/02* (2013.01); *B05B 15/025* (2013.01); *B05C 5/005* (2013.01)

(58) Field of Classification Search
CPC .. B05C 5/005; B05C 5/008; G03C 2001/747; B05B 15/02; B05B 15/025
USPC ..... 427/420
See application file for complete search history.

(56) References Cited

U.S. PATENT DOCUMENTS

| | | | | |
|---|---|---|---|---|
| 2,788,051 | A | 4/1957 | Tuttle | |
| 3,876,465 | A * | 4/1975 | Prazak, III | 427/64 |
| 5,330,797 | A * | 7/1994 | Mues | 427/420 |
| 6,117,236 | A * | 9/2000 | Ruschak et al. | 118/300 |
| 2008/0006203 | A1 * | 1/2008 | Morita et al. | 118/410 |
| 2010/0021645 | A1 | 1/2010 | Kobori et al. | |
| 2011/0059254 | A1 | 3/2011 | Somada et al. | |

FOREIGN PATENT DOCUMENTS

| | | | |
|---|---|---|---|
| EP | 2103357 | A1 | 9/2009 |
| JP | 5-15828 | | 1/1993 |
| JP | 10-5658 | | 1/1998 |
| JP | 10005658 | A * | 1/1998 |
| JP | 2011-78966 | | 4/2011 |

OTHER PUBLICATIONS

European search report dated Jul. 16, 2012 in connection with corresponding European patent application No. 12162024.9.

* cited by examiner

*Primary Examiner* — Alexander Weddle
(74) *Attorney, Agent, or Firm* — Cooper & Dunham LLP

(57) ABSTRACT

A curtain coating method including: discharging at least one coating liquid from a slot type die; forming a coating liquid film of the coating liquid freely falling; and applying the coating liquid film to a support medium continuously running, with both right and left ends of the coating liquid film being held by a pair of edge guides, wherein, during non-coating, a direction in which the coating liquid is discharged from the slot type die is kept in a horizontal direction or tilted from the horizontal direction in a direction distancing from the support medium.

11 Claims, 16 Drawing Sheets

CURTAIN COATING METHOD AND CURTAIN COATING DEVICE

BACKGROUND OF THE INVENTION

1. Field of the Invention

The present invention relates to a slot type curtain coating method and a slot type curtain coating device.

2. Description of the Related Art

In a slot type curtain method using a slot type die, a direction of discharging coating liquid from the slot type die is a direction of gravitational force (downward), and there is no slide part as in a slide type die, and there is no formation of a boundary layer by the slide part. Therefore, there hardly arises a problem of non-uniformity in film thickness in its width direction due to an increase in difference in film thickness between the thick film part and the thin film part in the vicinity of the both ends of the slide part. Therefore, by combining edge guides having appropriate structures and performances therewith, it is possible to form a curtain film whose fall velocity is uniform in its width direction, making it possible to obtain a coating film whose film thickness is uniform in the width direction. Further, because a shape of the die is relatively simple, which is easy to be processed, there is the feature that it is inexpensive.

However, in the slot type curtain method using the slot type die, because the direction of discharging coating liquid from the slot type die is the direction of gravitational force (downward), it is necessary to supply a large volume of coating liquid to the die at the time of replacing the air in a manifold of the die by the coating liquid at the start of coating. In a case of a single layer slot type curtain method, the coating liquid may be recovered to be reutilized. Meanwhile, in order to avoid the risk of contamination, the coating liquid may not be reutilized, but discarded in some cases. Further, air bubbles may be mixed into the coating liquid in the course of recovering the coating liquid after a coating liquid is discharged from the slot type die in some cases. However, because it is difficult to remove small air bubbles by existing defoaming devices and methods, there is the problem that it is necessary to discharge and recover a large volume of coating liquid in a work for replacing the air in the manifold of the slot type die by the coating liquid.

In order to solve the aforementioned problem, a method of providing an air exhaust vent is proposed as a method for replacing the air in the manifold of the slot type die in a slot type curtain method by the coating liquid (see Japanese Patent Application Laid-Open (JP-A) No. 05-15828). In this proposal, an air-bleeding outlet opening is provided to the manifold of the slot type die, and an antifoaming net is provided downstream thereof, and large-size air bubbles which do not pass through the antifoaming net are exhausted from the air-bleeding outlet opening. However, in this case, in order to replace the air in the manifold of the slot type die by the coating liquid, the coating liquid is discharged from the discharge opening of the slot type die to raise the liquid level in the manifold by its pressure loss, and the air is exhausted from the air-bleeding outlet opening by the pressure. Therefore, it is necessary to discharge a significant volume of coating liquid from the die, to recover or discard it. In particular, there is the problem that it is necessary to defoam air bubbles in a case of recovering high-viscosity coating liquid.

Further, because the direction of discharging coating liquid from the slot type die is the direction of gravitational force (downward) during suspension of coating, the coating liquid is leaked out little by little from the discharge opening of the die. As a result, air bubbles intrude or are accumulated in the manifold of the slot type die, and the air bubbles are broken in a lip part of the slot type die at the restart of coating, to contaminate the die lip to create coating streaks.

Further, when a liquid feed rate at the start of coating is low, the coating liquid falls while oscillating from side to side in a comb shape from a discharge opening of the slot type die. At this time, because the coating liquid in the vicinity of the both ends of the discharge opening of the slot type die oscillates from side to side, edge guides provided to the both ends in the width direction of the discharge opening of the slot type die or the flowing-down surface of supplemental water from the edge guides may be contaminated. In this state, flowing-down of the supplemental water is disturbed, so that the fall velocity at the edges of the curtain film decreases to deteriorate the uniformity in film thickness. Also, when a curtain film is formed with the edge guides contaminated, the formed curtain film warps or does not fall vertically, thereby generating streaks so as to draw a circular arc ranging from contact portions between the curtain film and the edge guides to the impact area between the curtain film and a support medium. Corrugated turbulence is caused at the impact area, which problematically deteriorates the uniformity in film thickness.

Moreover, because the direction of discharging coating liquid from the slot type die is the direction of gravitational force (downward), it is hard to check the position of the slot in the case where a cleaning reed-shaped film is inserted into the slot of the slot type die to clean it. Therefore, it is difficult to clean the slot of the slot type die. Further, when a cleaning reed-shaped film is inserted upward into the slot to clean it, the arms of a worker are upward, and the cleaning liquid or cleaning waste liquid flows down along the arms of the worker. Therefore, there is the problem that at least one of the arms and the clothes of the worker is contaminated with the cleaning liquid or the cleaning waste liquid.

Further, as a method for facilitating cleaning of the slot and the lip of the slot type die of the slot type curtain coating device, for example, it has been proposed to support the right and left both ends of the die rotatably with respect to a support frame (see JP-A No. 10-5658). However, this proposal focuses on merely facilitation of cleaning of the slot and the lip of the slot type die, and does not intend to improve uniformity in coating, and to solve various problems caused at the start of coating of the slot type curtain coating method and during temporary suspension of coating.

SUMMARY OF THE INVENTION

An object of the present invention is to provide a slot type curtain coating method and curtain coating device without using and discarding a large volume of coating liquid in order to remove air bubbles in a manifold of a slot type die at the start of coating, without air bubbles mixed in the manifold of the slot type die during temporary suspension of coating, without using a large volume of cleaning liquid or coating liquid at the restart of coating after temporary suspension of coating, without contaminating arms or clothes of a worker in a work for cleaning the slot and the lip of the die, with involving less contamination of the edge guides due to scattering of cleaning liquid or coating liquid, and without involving deterioration of the uniformity in film thickness which would be caused when a curtain film warps or does not fall vertically as a result of disturbance of the flowing-down of the supplemental water for edge guides due to contamination of the edge guides.

Means for solving the aforementioned problems are as follows. That is, a curtain coating method of the present invention includes:

discharging at least one coating liquid from a slot type die;

forming a coating liquid film of the coating liquid freely falling; and applying the coating liquid film to a support medium continuously running, with both right and left ends of the coating liquid film being held by a pair of edge guides, wherein, during non-coating, a direction in which the coating liquid is discharged from the slot type die is kept in a horizontal direction or tilted from the horizontal direction in a direction distancing from the support medium.

Here, preferably, the slot type die is rotated integrally with or in synchronization with the edge guides, and the edge guides are moved from positions at which the edge guides are located during coating.

Also, preferably, the slot type die is rotated independently of the edge guides, and the edge guides are moved from positions at which the edge guides are located during coating.

Also, preferably, when the amount of the coating liquid discharged from the slot type die is smaller than that in which the curtain film can be formed, the edge guides are moved from the positions at which the edge guides are located during coating to the positions other than a region where the coating liquid falls.

The region where the coating liquid falls means a space determined by the thickness, the width and the height of the curtain film made of the coating liquid.

A curtain coating device of the present invention includes:

a slot type die from which at least one coating liquid is discharged to form a coating liquid film of the coating liquid freely falling;

a pair of edge guides which hold both right and left ends of the coating liquid film to be applied to a support medium continuously running, and a unit configured, during non-coating, to keep a direction in which the coating liquid is discharged from the slot type die in a horizontal direction or to tilt the direction in which the coating liquid is discharged from the slot type die from the horizontal direction in a direction distancing from the support medium.

Here, preferably, the curtain coating device includes a moving unit configured to move the edge guides from the positions at which the edge guides are located during coating.

In accordance with the present invention, it is possible to solve the conventional problems, and it is possible to provide a slot type curtain coating method and curtain coating device without using and discarding a large volume of coating liquid in order to remove air bubbles in a manifold of a slot type die at the start of coating, without air bubbles mixed in the manifold of the slot type die during temporary suspension of coating, without using a large volume of cleaning liquid or coating liquid at the restart of coating after temporary suspension of coating, without contaminating arms or clothes of a worker in a work for cleaning the slot and the lip of the die, with involving less contamination of the edge guides due to scattering of cleaning liquid or coating liquid, and without involving deterioration of the uniformity in film thickness which would be caused when a curtain film warps or does not fall vertically as a result of disturbance of the flowing-down of the supplemental water for edge guides due to contamination of the edge guides.

Figure 1:
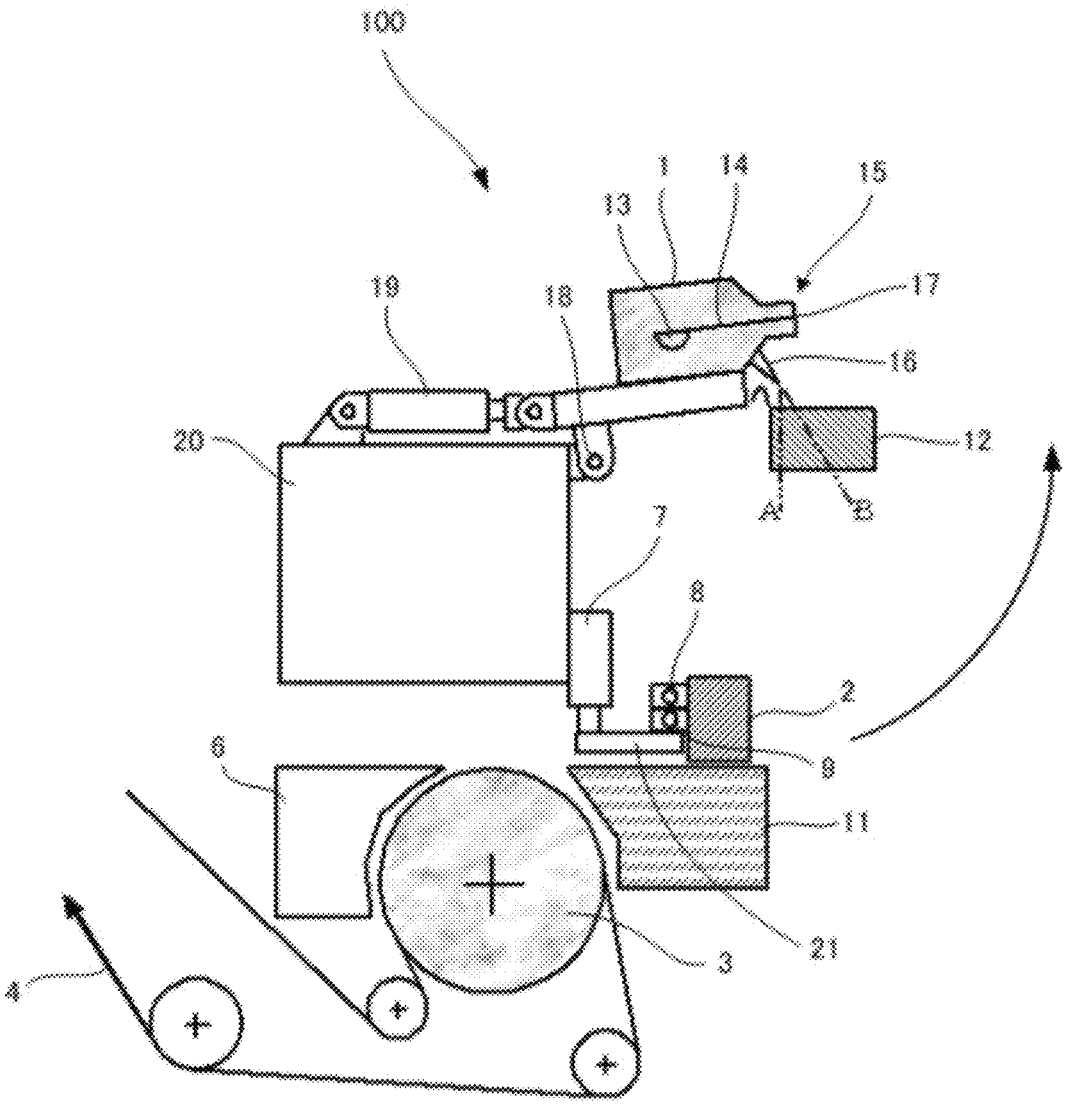
FIG. 1 is a side view showing an example of a slot type curtain coating device of the present invention.

DETAILED DESCRIPTION OF THE INVENTION (Curtain Coating Method and Curtain Coating Device)

A curtain coating device of the present invention is a device including: a slot type die containing a discharge opening from which at least one coating liquid is discharged to form a coating liquid film of the coating liquid freely falling; and a pair of edge guides which hold both right and left ends of the coating liquid film to be applied to a support medium continuously running. Specifically, the curtain coating device includes a discharging unit and a pair of edge guides; and, if necessary, further includes appropriately selected other units such as a conveying unit.

A curtain coating method of the present invention includes: discharging at least one coating liquid from a discharge opening of a slot type die; forming a coating liquid film of the coating liquid freely falling; and applying the coating liquid film to a support medium continuously running, with both right and left ends of the coating liquid film being held by a pair of edge guides. Specifically, the curtain coating method includes a discharging step; and, if necessary, further includes appropriately selected other steps such as a conveying step.

In the present invention, during non-coating, the direction in which the coating liquid is discharged from the slot type die is kept in the horizontal direction or tilted from the horizontal direction in the direction distancing from the support medium. Thereby, it is possible to suppress generation of coating loss in the conventional slot type curtain coating method, and it is possible to significantly suppress generation of the disposal loss of the coating liquid at the start of coating.

The term "during non-coating" here means any one of "before the start of coating," "during temporary suspension of coating" or "at the end of coating."

The direction of discharging the coating liquid from the slot type die is preferably tilted from the horizontal direction at an angle greater than 0 degrees but equal to or smaller than 60 degrees in the direction distancing from the support medium, more preferably at 5 degrees to 30 degrees. When the tilt angle is horizontal (0 degrees) or more, it is practically possible to discharge air bubbles in the same way. However, the tilt angle is preferably 5 degrees to 30 degrees in view of the fact that it is possible to reliably exhaust air bubbles and a short time is sufficient as an exhaust time.

Further, in the present invention, the slot type die is preferably movable in the direction of gravitational force in a state where the direction in which the coating liquid is to be discharged from the slot type die is kept in the horizontal direction or tilted from the horizontal direction in the direction distancing from the support medium. Thereby, it is possible to prevent contamination of the surrounding area due to dripping, and it is easy to carry out cleaning of the slot and the lip of the slot type die or a work for exhausting air bubbles of the manifold before the start of coating, which enhances the workability and improves the productivity.

<Discharging Unit and Discharging Step>

The discharging unit is a unit containing a discharge opening from which a coating liquid is discharged, and the discharging step is a step of discharging the coating liquid from the discharge opening.

The coating liquid goes through a pump, a filter, a liquid temperature controller, a branch valve from a coating liquid stock tank, and is fed to the slot type die or a coating head of the curtain coating device to be applied to a web.

—Coating Liquid—

As the aforementioned coating liquid, it is not limited in particular, and it may be appropriately selected for any purpose. For example, an acrylic emulsion liquid, a heat sensitive liquid, a thermal transfer ribbon coating liquid, a water-based coating liquid, a solvent-based coating liquid may be given as an example. The aforementioned coating liquid may be used separately as one type, and two types of those may be used together.

As the viscosity of the coating liquid, it is not limited in particular, and it may be appropriately selected for any purpose. Meanwhile, it is preferably 1 mPa·s to 2,000 mPa·s at 25° C.

When the viscosity of the coating liquid is less than 1 mPa·s, dripping may be caused from the slit of the slot type die in a case of suspending the coating, and when the viscosity of the coating liquid is greater than 2,000 mPa·s, (1) air bubbles in the coating liquid are hardly removed, and a defect may be caused due to the air bubbles in the coating liquid, or (2) the discharging pressure of the coating liquid is increased, thereby increasing the load on the liquid feed pump, and the pressure resistance of the liquid supply system may be required in some cases.

The aforementioned viscosity may be measured by use of a B type viscosity meter for example.

As the surface tension of the coating liquid, it is not limited in particular, and it may be appropriately selected for any purpose. Meanwhile, it is preferably 20 mN/m to 40 mN/m.

When the surface tension is less than 20 mN/m, because the surface tension of the film itself is weak, the tension of the film is weak, and the film may be easily deformed by disturbance due to wind in some cases. On the other hand, when the surface tension is greater than 40 mN/m, the curtain film may be cut up.

With respect to the surface tension, the static surface tension may be measured by a platinum plate method by use of a FACE automatic surface tensiometer (manufactured by Kyowa Interface Science Co., LTD.) for example.

The dynamic surface tension may be measured by the method described in, for example, "A study of the behaviour of a thin sheet of moving liquid" D. R. Brown. Journal of Fluid Mechanics 10, pp. 297-305. 1961, in which the dynamic surface tension is calculated from the split angle of a curtain film when a needle-like product is inserted into the curtain film.

—Coating Liquid Discharge Opening—

The cross-sectional shape of the coating liquid discharge opening is preferably a rectangular cross section.

As a size of the coating liquid discharge opening, it is not limited in particular, and it may be appropriately selected for any purpose. Meanwhile, its clearance is preferably 0.2 mm to 0.5 mm.

The slit (clearance) has a function of uniformizing the coating liquid in the width direction, and the size of the clearance changes depending on a size and a shape of a manifold of the slot type die, a distance from the manifold to the slit outlet, and changes depending on a flow rate and its viscosity of the coating liquid as shown in "Slot Coating: Fluid mechanics and die design, Sartor, Luigi, Ph.D. University of Minnesota, 1990."

As a material of the discharge opening, it is not limited in particular, and it may be appropriately selected for any purpose. Meanwhile, it is preferably a stainless steel (SUS) material, an aluminum material, a metal surface of plating such as hard chrome plating.

In addition, even in the case where resin is contained in the coating liquid, it is preferable to use metal as a material of the discharge opening in view of that fact that it is possible to prevent clogging.

—Discharge Mechanism—

As a discharge mechanism for discharging the coating liquid, a slot type die is used.

The slot type die is used for the case where one layer or two-layered coating liquid is applied, and the direction of discharging coating liquid is the direction of gravitational force (downward). Therefore, in the case where the viscosity of the coating liquid is low, dripping may be caused, air bubbles in the coating liquid may be accumulated in the manifold of the slot type die in some cases. However, because the slot type die has a discharge rate of coating liquid higher than that of a slide type die, in consideration of the mechanism of cutting-up of curtain film that a curtain film is cut up when the dynamic surface tension is high by the balance between the dynamic surface tension of the coating liquid and the dynamical pressure (inertial force) when the coating liquid falls, cutting-up is hardly caused in the slot type curtain coating method. Further, because there is no open space as in the slide flowing-down surface in the slide type die, it is easy to carry out cleaning, and its cleaning liquid such as water used for cleaning is minimal. Further, in the case where the viscosity of the coating liquid is high, temporary suspension of operation as well is easy.

—Coating Liquid Flow Rate—

A coating liquid flow rate at which the coating liquid is discharged is not limited in particular as long as it is possible to form the curtain film, and it may be appropriately selected for any purpose.

—Support Medium—

As the support medium, it is not limited in particular as long as it is possible to support the coating liquid, and it may be appropriately selected for any purpose.

As a shape, a structure, and a size of the support medium, these are not limited in particular, and these may be appropriately selected for any purpose.

As the support medium, for example, a release paper, a base paper, a synthetic paper, or a PET film may be given as an example.

<Conveying Unit and Conveying Step>

The conveying unit is a unit configured to convey the support medium, and the conveying step is a step of conveying the support medium. Examples of the conveying unit include a conveying roller and a conveying belt.

—Purpose—

The curtain coating method and the curtain coating device of the present invention are suitably used for preparing, for example, a silver halide photosensitive material, a magnetic recording material, a pressure-sensitive recording material, a heat sensitive recording material, a self-adhesive label, an art paper, a coated paper, an inkjet recording sheet.

Hereinafter, the curtain coating method and the curtain coating device of the present invention will be described in more detail on the basis of the drawings. In addition, because embodiments which will be described hereinafter are preferred embodiments of the present invention, technically favorable various limitations are added thereto. However, the scope of the present invention is not limited to these embodiments unless description of the purpose of particularly limiting those is made in the following descriptions.

First Embodiment

Here, FIG. 1 is a side view showing an example of a slot type curtain coating device of the present invention. The coating device 100 of FIG. 1 has a slot type die 1, edge guides 2, a backup roll 3, a support medium 4, a rotating center 18, and a rotational moment generating unit 19, where the rotating center 18 and the rotational moment generating unit 19 serve as a rotating unit. In addition, in FIG. 1, respectively, reference numeral 6 denotes a vacuum chamber, reference numeral 7 denotes an edge guide elevating cylinder, reference numeral 8 denotes a back and forth slide unit, reference numeral 9 denotes a right and left slide unit, reference numeral 11 denotes a liquid receiving pan, reference numeral 12 denotes a die cleaning and air bubble removal pan, reference numeral 13 denotes a manifold, reference numeral 14 denotes a slot, reference numeral 15 denotes a die lip, reference numeral 16 denotes a liquid flowing-down guide plate, reference numeral 17 denotes a discharge opening, reference numeral 20 denotes a coating head frame, and reference numeral 21 denotes an edge guide spacing unit serving as a support member as well. In addition, the back and forth slide unit 8 and the right and left slide unit 9 are able to serve as spacing unit as well.

The coating device 100 of FIG. 1 shows a relative positional relationship of the slot type die 1, the edge guides 2, and the backup roll 3 during non-coating which is any one of "before the start of coating," "during temporary suspension of coating" or "at the end of coating," and the discharge opening 17 of the slot type die 1 is disposed in a direction obliquely upward with respect to the backup roll 3.

Figure 2:
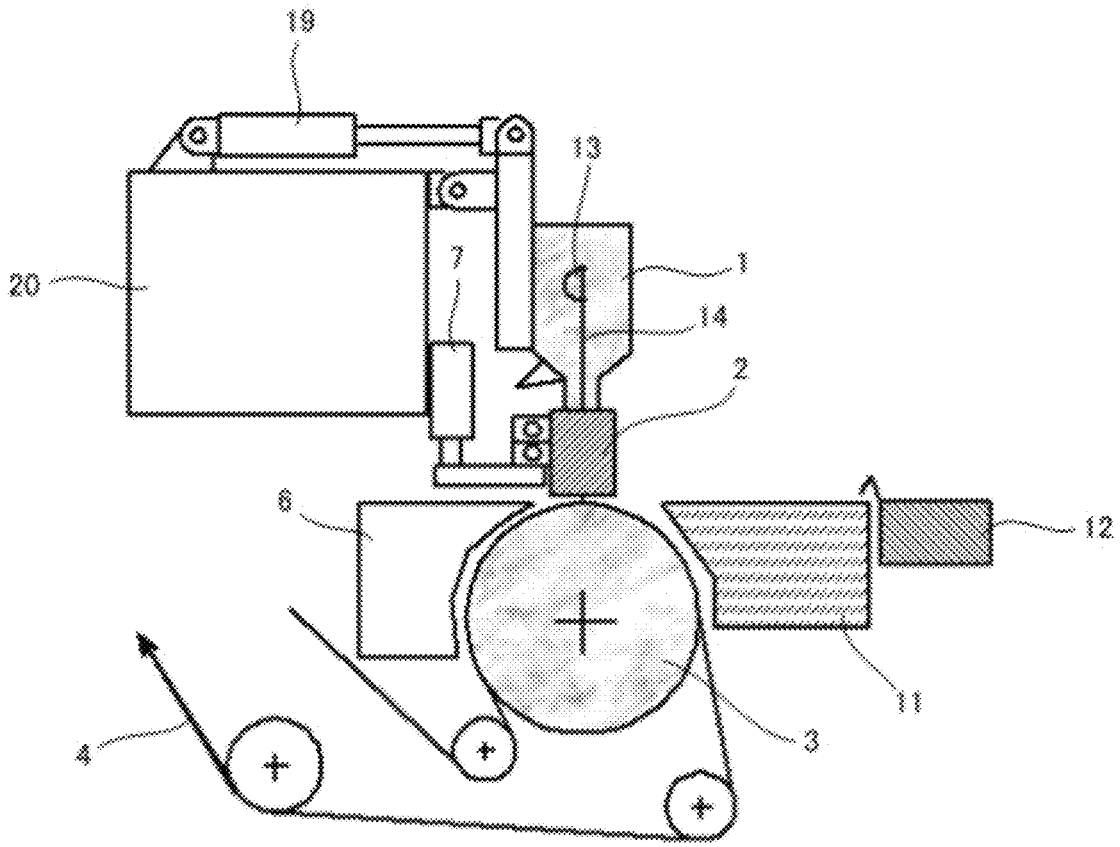
FIG. 2 is a side view showing the slot type curtain coating device during coating.

As shown in FIG. 2, during coating, the discharge opening 17 of the slot type die 1 is directed toward the direction of gravitational force (downward) with respect to the backup roll 3 in the same way as that of the conventional slot type curtain coating device. In this state, coating is stably performed.

Figure 3:
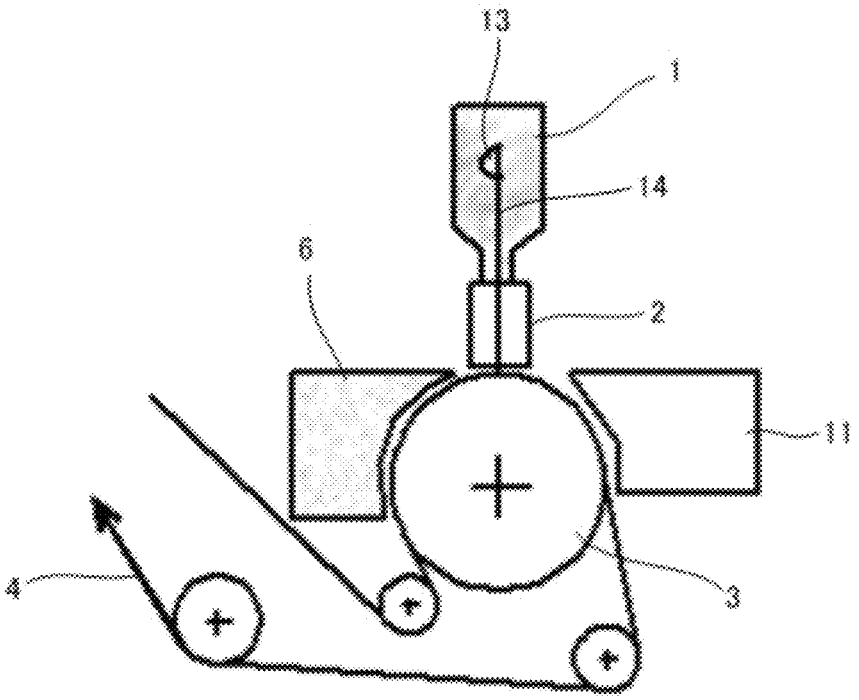
FIG. 3 is a side view showing a conventional slot type curtain coating device during non-coating.

Meanwhile, as shown in FIG. 3, in a state where the slot type die 1 is directed toward the direction of gravitational force (downward) during non-coating, air intrudes from the slot 14 of the slot type die 1 in several seconds to several minutes, and the air is accumulated in the manifold 13. When the coating liquid is discharged from the slot 14 in this state, to start coating, the air accumulated in the manifold 13 becomes air bubbles to get mixed in the coating liquid, to be painted on the support medium 4, and the air bubbles are broken to bring about a defect of coating unevenness.

In order to prevent this problem, a method for preventing the coating liquid from flowing out by pasting a self-adhesive tape onto the die lip 15 of the slot type die 1 during non-coating has been adopted. However, it is necessary to clean the die lip 15 with water or an organic solvent at the start or at the restart of coating, and in production model curtain coating devices whose coating widths are 1 m to 2 m, the coating liquid may flow out from the slot 4 of the slot type die 1 during this time in some cases.

Further, when the coating liquid immediately before the restart of coating is discharged to form a curtain film, air bubbles are expanded to be broken at the discharge opening 17 of the slot type die 1 in some cases. Due to this breaking of bubbles, liquid drops of the coating liquid adhere to the lip 15 of the slot type die 1, thereby making a coating film in which streaks are formed on a curtain film, and those are transcribed onto the support medium 4 to bring about a defect of coating streaks.

In this way, in the conventional slot type curtain coating device, there is the problem that air intrudes the manifold 13 of the slot type die 1 during temporary suspension of coating, to bring about a defect of coating and a coating loss.

Further, before the start of coating, in a case of the conventional slot type curtain coating method and curtain coating device, it is necessary to supply a large volume of coating liquid to the slot type die 1 to discard it in order to replace the air in the manifold 13 of the die by the coating liquid.

In the present invention, as shown in FIG. 1, after temporary suspension of coating, by promptly rotating the slot type die 1 in appropriately several seconds to several tens of seconds, the discharge opening 17 of the slot type die 1 is held in a posture of being kept in the horizontal direction or tilted from the horizontal direction in the direction distancing from the support medium, which makes it possible to prevent the coating liquid from dropping, and prevent the air from intruding into the slot 14 from the discharge opening 17 of the slot type die 1 according to the dropping.

There is no problem in a case where a time up to the start of rotating the slot type die after temporary suspension of coating is a time within a range in which the coating liquid does not drop from the slot 14 of the slot type die 1 and air does not intrude into the manifold 13 from the slot 14. This depends on the viscosity of the coating liquid and a size of the clearance in the slot 14.

Before the start of coating, it suffices to discharge a very small amount of coating liquid in order to replace the air in the manifold 13 by the coating liquid in a posture in which the discharge opening 17 of the slot type die 1 is kept in the horizontal direction or tilted from the horizontal direction in the direction distancing from the support medium.

In this case, because it may be caused that a slight amount of coating liquid and air are mixed in the course of replacement, an amount of supplying the coating liquid to the slot type die 1 is preferably small.

Because a level of the amount of supplying the coating liquid differs depending on the viscosity, the viscosity characteristic, and the concentration of the coating liquid, the width of the slot type die 1, and is not limited in particular, it is preferable to appropriately set the level.

As a result, in the conventional slot type curtain coating method, it is possible to suppress generation of coating loss at the end of coating or during temporary suspension of coating, and it is possible significantly suppress generation of the disposal loss of the coating liquid at the start of coating.

In the present invention, as long as it is a slot type curtain coating method, any one of single-layer coating and simultaneous multilayer coating is available.

Further, the direction in which the coating liquid is to be discharged from the discharge opening 17 of the slot type die 1 is preferably at 0 degrees to 60 degrees obliquely upward from the horizontal direction, more preferably at 5 degrees to 30 degrees.

Moreover, provided that the manifold 13 is provided to the lower plate between the two plates forming the slot type die 1 when the direction in which the coating liquid is to be discharged from the slot type die 1 is kept in the horizontal direction or obliquely upward, it is easy to exhaust the air, which is preferable.

As shown in FIG. 1, the rotational mechanism of the die 1 that changes the direction of discharging of the discharge opening 17 of the slot type die 1 is composed of the rotating center 18 and the rotational moment generating unit 19. Further, as the rotational moment generating unit 19, for example, a pneumatic cylinder, a hydraulic cylinder, an electric cylinder, a rotary oscillating actuator may be given as an example.

Further, even when an electric, pneumatic, or hydraulic power source of the rotational moment generating unit 19 stops, by including a mechanical positioning stopper (not shown) which is capable of retaining the posture in which the discharge opening 17 of the slot type die 1 is kept in the horizontal direction or tilted from the horizontal direction to the direction distancing from the support medium, it is possible to prevent the air from intruding into the manifold 13 of the slot type die 1 due to replacement of the air by the coating liquid during suspension.

In addition, in the present invention, it is possible to design the equipment so as to use a sequence program by which a depth position of the slot type die 1 or the edge guides 2 with the curtain film serving as the front face is sensed by a limit switch, or a value to instruct a liquid feed rate of the coating liquid or a current value as a liquid feed rate is sensed, to automatically rotate the slot type die 1.

FIG. 1 shows the state in which the slot type die 1 is rotated such that the discharge opening 17 is obliquely upward. FIG. 1 shows the posture of the slot type die 1 at the time of replacing the air in the manifold 13 by the coating liquid before the start of coating, or during temporary suspension of coating, and further at the time of cleaning the die lip 15 of the slot type die 1 during temporary suspension of coating, and furthermore at the end of coating. At this time, with respect to the coating head frame 20 having the slot type die 1, the edge guides 2, the position of the edge guides 2 moves from the position during coating shown in FIG. 2 which is in the vicinity of substantially the top of the backup roll 3, to be usually at the position on the side of a coating operator on the right side as shown in FIG. 1 from the vicinity of the top of the backup roll 3. A moving distance from the vicinity of the top of the backup roll 3 is usually approximately 50 mm to approximately 300 mm, and differs depending on a structure of each curtain coating device.

Further, as shown in FIG. 1, by providing the die cleaning and air bubble removal pan 12 in the vicinity of the slot type die 1, it is possible to prevent splashing of liquid associated with dropping of the coating liquid discharged from the discharge opening 17 of the slot type die 1, and contamination generated by the splashing of liquid.

At the time of replacing the air in the manifold 13 of the slot type die 1 by the coating liquid, in the case where the die cleaning and air bubble removal pan 12 are not under the vicinity of the slot type die 1, but under several tens of centimeters away from it when the coating liquid is discharged from the discharge opening of the slot type die 1, the die cleaning and air bubble removal pan 12 serves as a partial function as a liquid receiving pan. However, the problem that the curtain coating device or the working clothes of a worker is contaminated by splashing of liquid associated with dropping of the discharged coating liquid may be brought about.

In particular, because a large volume of solvent is used in a case of cleaning the inside of the slot type die 1 with a solvent such as water after the end of coating or in order to change the coating liquid, a liquid feed rate to the slot type die 1 as well is increased. Therefore, the effects of contamination by scattering and splashing of liquid due to dropping of the cleaning waste liquid are great.

Moreover, at this time, under the slot type die 1, the coating liquid discharged from the discharge opening 17 of the slot type die 1 or the cleaning waste liquid flows along the lower surface of the slot type die 1 to contaminate this surface, and the coating liquid scatters in many directions to drop, which makes it impossible to avoid contamination by the splashing of liquid.

As shown in FIG. 1, when the direction in which the coating liquid is to be discharged from the discharge opening 17 of the slot type die 1 is kept in the horizontal direction or tilted from the horizontal direction in the direction distancing from the support medium, by providing the die cleaning and air bubble removal pan 12 and the flowing-down guide plate 16 so as to introduce the coating liquid into the die cleaning and air bubble removal pan 12, it is possible to prevent scattering of the coating liquid.

A length of the die cleaning and air bubble removal pan 12 not limited in particular as long as it is sufficiently longer than the coating liquid discharging width of the slot type die 1, and it may be appropriately selected for any purpose. However, it is preferable that the length has an area including at least the vertical line A on the lower end of the flowing-down guide plate 16 and the extended line B of the liquid flowing-down surface.

The die cleaning and air bubble removal pan 12 may be rotated integrally with the slot type die 1. Further, the die cleaning and air bubble removal pan 12 may be moved separately from the rotating motion of the slot type die 1. In this case, it suffices that the die cleaning and air bubble removal pan 12 may be moved to be disposed directly under the slot type die 1 when the slot type die 1 is kept in the horizontal position or kept between the horizontal position and an upper position.

Moreover, in a case of using a high-viscosity coating liquid, in order to improve the fluidity of the coating liquid in the die cleaning and air bubble removal pan 12, to easily exhaust it, it is preferable to provide water discharge nozzles over the entire width of the die cleaning and air bubble removal pan 12.

The flowing-down guide plate is not limited in particular as long as its width is greater than or equal to the width of the discharge opening, and it may be appropriately selected for any purpose. Meanwhile, it is preferably wider by approximately 10 mm to approximately 30 mm than the width of the discharge opening. The length of the flowing-down guide plates is not particularly limited as long as the length is sufficient to guide the coating liquid to the liquid receiving pan, and may be appropriately selected for any purpose. When the direction in which the discharge opening of the coating liquid in the slot type die 1 faces is tilted in the direction distancing from the support medium, the angle formed between the flowing-down surface and the horizontal surface is preferably 0 degrees or greater but equal to or smaller than 60 degrees, more preferably approximately 45 degrees in view of the fact that flowing-down of the coating liquid is smooth. The lower end of the flowing-down surface is not limited in particular as long as it has an acute angle, and it may be appropriately selected for any purpose. The distance between the discharge opening and the flowing-down surface at the side of the discharge opening is preferably near the discharge opening in view of not contaminating the die head. However, it is preferably 10 mm or more in consideration of the workability for cleaning the lip of the slot type die 1.

The flowing-down guide plate may be a detachable type or a fixing type. As a material thereof, for example, nylon-based resin, polypropylene-based resin, resin of polyethylene terephthalate (PET); metal such as aluminum or stainless steel may be given as an example.

In the present invention, the slot type die is rotated in the following two manners (1) and (2) when the coating liquid is not formed into the curtain film: (1) the slot type die is rotated, to a position for coating, from a position at which the direction of discharging the coating liquid is a horizontal direction or tilted from the horizontal direction in a direction distancing from the support medium and (2) the slot type die is rotated from a position for coating to a position at which the direction of discharging the coating liquid is a horizontal direction or tilted from the horizontal direction in a direction distancing from the support medium at the end of coating or during temporary suspension of coating. While the slot type die is being rotated, preferably, the coating liquid is not discharged from the discharge opening of the slot type die. However, the coating liquid may be discharged in such a small amount that the lip is not contaminated.

Here, the following embodiments (1) to (3) are preferred.

(1) The slot type die is rotated integrally with or in synchronization with the edge guides, and the edge guides are moved from the positions at which the edge guides are located during coating.

(2) The slot type die is rotated independently of the edge guides, and the edge guides are moved from the positions at which the edge guides are located during coating.

(3) When the amount of the coating liquid discharged from the slot type die is smaller than that in which the curtain film can be formed, the edge guides are moved from the positions at which the edge guides are located during coating to the positions other than a region where the coating liquid falls.

The region where the coating liquid falls means a space determined by the thickness, the width and the height of the curtain film made of the coating liquid.

Preferred embodiments of (1) to (3) are the following embodiments (1') to (3'), respectively.

(1') The slot type die is rotated integrally with or in synchronization with the edge guides, and the edge guides are moved so that the distance between the edge guides is changed.

(2') The slot type die is rotated independently of the edge guides, and the edge guides are moved so that the distance between the edge guides is changed.

(3') When the amount of the coating liquid discharged from the slot type die is smaller than that in which the curtain film can be formed, the edge guides are moved so that the distance between the edge guides is greater than the width of the discharge opening of the slot type die.

Figure 16:
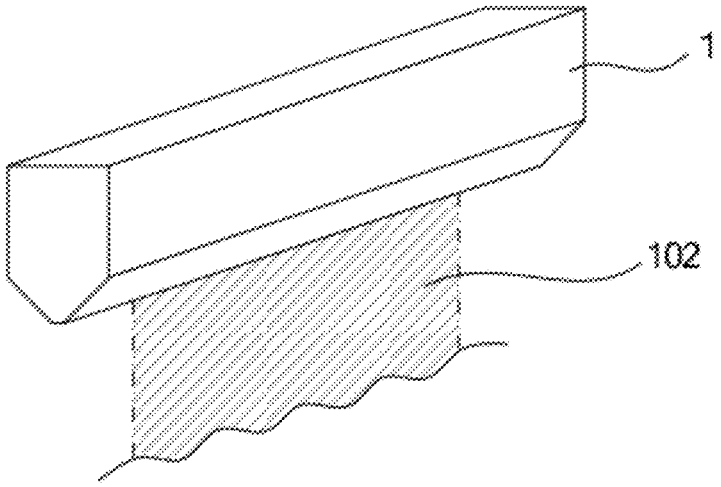
FIG. 16 is a view showing a state where a coating liquid is discharged so as to form a curtain film when the direction in which the coating liquid is discharged from a slot type die is the direction of gravitational force (downward).

FIG. 16 illustrates a state where the coating liquid is discharged so as to form a curtain film when the coating liquid is discharged from the slot type die 1 in the direction of gravitational force (downward). In FIG. 16, reference numeral 102 denotes a region where the coating liquid falls down.

Figure 17:
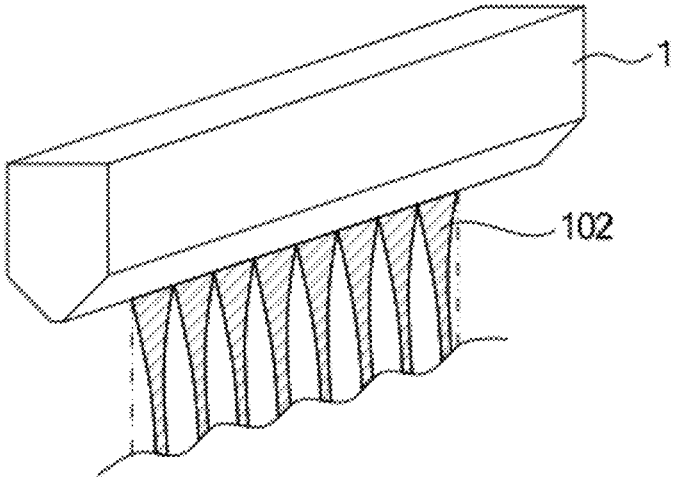
FIG. 17 is a view showing a state where a coating liquid is discharged in such a small amount as not to form a curtain film when the direction in which the coating liquid is discharged from a slot type die is the direction of gravitational force (downward).
Figure 18:
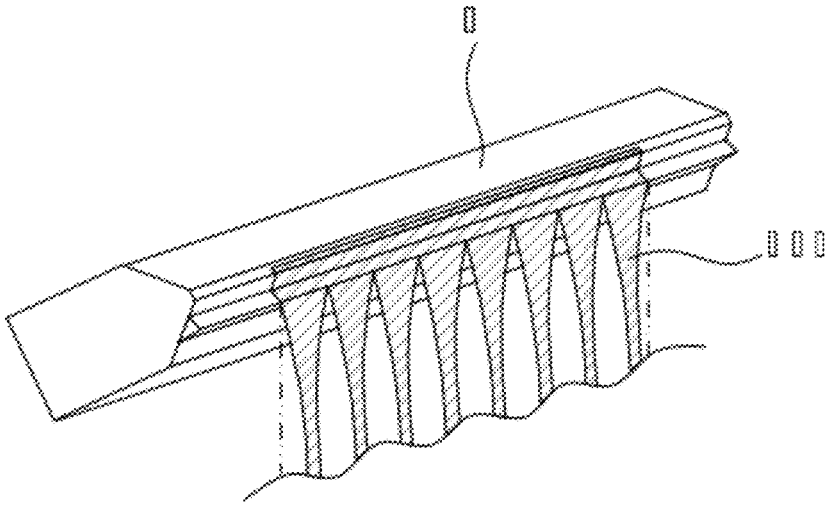
FIG. 18 is a view showing a state where a coating liquid is discharged from a discharge opening of a slot type die kept in the horizontal direction or tilted from the horizontal direction in the direction distancing from a support medium.

When the coating liquid is discharged in such a small amount as not to form a curtain film when the coating liquid is discharged from the slot type die 1 in the direction of gravitational force (downward) (FIG. 17) and when the discharge opening of the slot type die 1 is kept in the horizontal direction or tilted from the horizontal direction in a direction distancing from the support medium (FIG. 18), regardless of whether the coating liquid is discharged or not, the flowing-down surfaces of the curtain film in the edge guides are moved to other positions than a region where the coating liquid falls (i.e., shaded region 102 in FIG. 17 and FIG. 18) and the edge guides are spaced from each other in a coating width direction from the positions thereof during coating.

In this case, the slot type die may be rotated integrally with or in synchronization with the edge guides, or may be rotated independently of the edge guides.

By combining them with the die cleaning and air bubble removal pan 12 or the liquid receiving pan 11, it is possible to prevent contamination of the surroundings and the edge guides 2 caused by the coating liquid or cleaning liquid discharged during cleaning of the die lip, slot and manifold.

The slot type die 1 may be rotated integrally with or in synchronization with the edge guides 2, or may be rotated separately from the edge guides 2.

In the case where the slot type die 1 is rotated integrally with or in synchronization with the edge guides 2, the discharge opening 17 of the slot type die 1 is held in a posture of being kept in the horizontal direction or tilted from the horizontal direction in the direction distancing from the support medium, and at the time of replacing the air in the manifold 13 by the coating liquid before the start of coating and during temporary suspension of coating, or at the time of cleaning the discharge opening 17 and the lip 15 of the slot type die 1, and further at the end of coating, the coating liquid touches the edge guides 2 at the both ends in the coating width direction of the discharge opening 17 at the moment of discharging the coating liquid from the lip 15 of the slot type die 1 regardless of a large or small discharge rate of the coating liquid, and the coating liquid adheres to the flowing-down surface or flowing-down member of supplemental water with the curtain film guiding member of the edge guides 2 or the edge guides 2 configured to flow the supplemental water down.

Moreover, in the case where a cleaning reed-shaped film is inserted to clean the discharge opening 17 and the die lip 15 of the slot type die at the time of cleaning these, on the both ends of the discharge opening 17, not only do the edge guides 2 lie in the way of a work of the worker, but also the coating liquid or the cleaning liquid inside the slit scatters by the insertion of the reed-shaped film, to adhere to the flowing-down surface or flowing-down member of supplemental water with the curtain film guiding member of the edge guides 2 or the edge guides 2 configured to flow the supplemental water down.

With the curtain film guiding member of the edge guides 2 or the edge guides 2 configured to flow the supplemental water down, in the case where the coating liquid or the cleaning liquid is adhered to the flowing-down surface or flowing-down member of supplemental water, regardless of using or not using the supplemental water, the curtain film does not fall down when a curtain film is directly formed in some cases. Or, the curtain film is curved, to generate streaks so as to draw a circular arc from the contact portion of the curtain film with the edge guides to the impact area with the base material of the curtain film, and corrugated turbulence is caused in the curtain film at the impact area, which deteriorates the uniformity in film thickness.

Further, in a case of using the supplemental water, flowing-down of the supplemental water is disturbed, to reduce the fall velocity of the supplemental water, and to reduce the fall velocity at the edges of the curtain film, which deteriorates the uniformity in film thickness.

Figure 5:
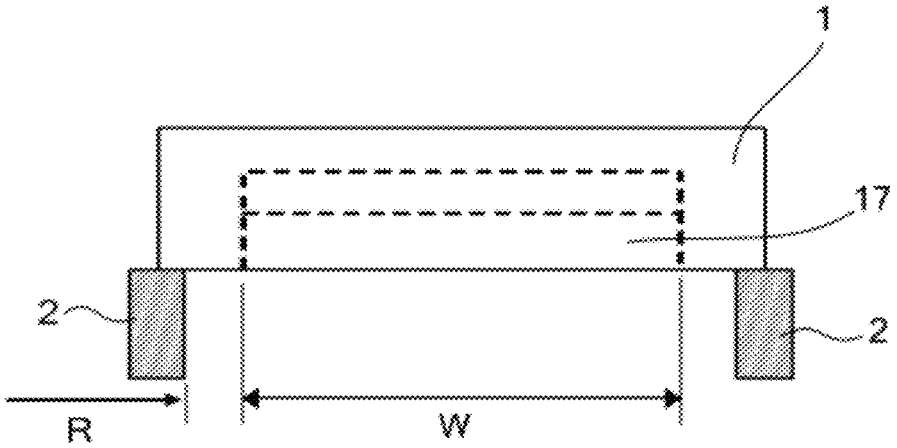
FIG. 5 is a schematic view showing an example that the positions of the edge guides are spaced in a coating width direction from the positions during coating.

Therefore, when the slot type die 1 is rotated integrally with or in synchronization with the edge guides 2 to be a posture where the direction in which the coating liquid is to be discharged is kept in the horizontal direction or tilted from the horizontal direction in the direction distancing from the support medium, the edge guides 2 are moved to positions except for the lower side in the coating width direction of the discharge opening of the slot type die 1, to space the flowing-down surface of supplemental water from the edge guides 2 from a width W of the discharge opening of the slot type die 1 in FIG. 5, thereby, it is possible to prevent the coating liquid from adhering to the flowing-down surface or flowing-down member of supplemental water with the curtain film guiding member of the edge guides 2 or the edge guides 2 configured to flow the supplemental water down.

Figure 4:
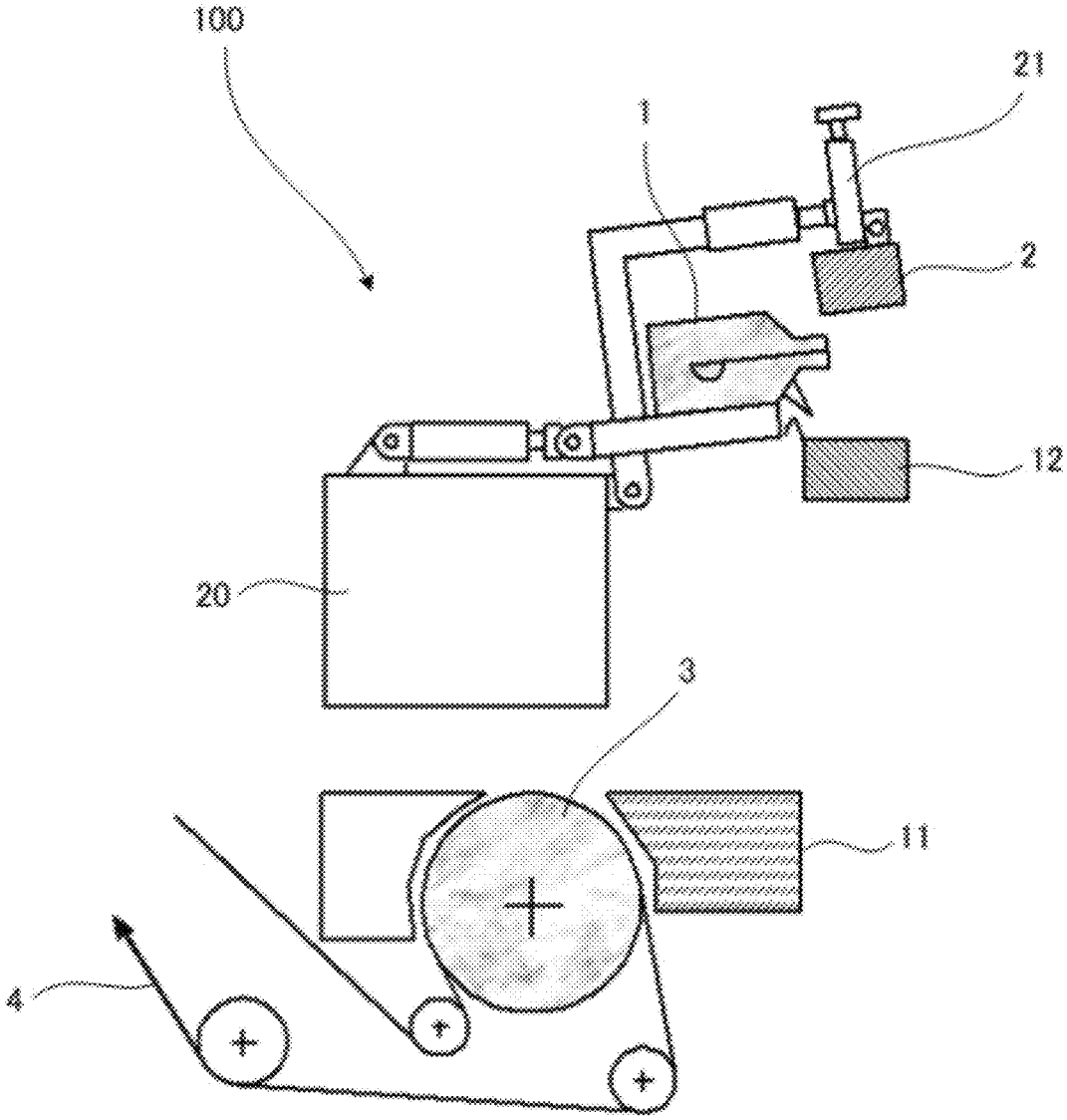
FIG. 4 is a side view showing an example that a slot type die and edge guides rotate in synchronization.

FIG. 4 shows an example in which the slot type die 1 and the edge guides are rotated in synchronization, and shows a case where the edge guides 2 are moved to the upper side in a direction orthogonal to the coating width direction of the discharge opening of the slot type die 1 by a sliding motion of the edge guide spacing unit 21, to space the flowing-down surface of the curtain film of the edge guides 2 from the discharge opening of the slot type die 1.

In the present invention, when the direction in which the coating liquid is discharged from the slot type die 1 is set in the direction of gravitational force (downward) and the coating liquid is discharged in an amount smaller than that in which the curtain film can be formed, the edge guides are preferably spaced from each other so that the distance between the edge guides is greater than the width of the discharge opening of the slot type die. Also, when the lip and slot of the slot type die are cleaned in a state where the direction in which the coating liquid is discharged is kept in the horizontal direction or tilted from the horizontal direction in the direction distancing from the support medium, regardless of whether the coating liquid is discharged or not, the edge guides are preferably moved so that the distance between the edge guides is changed.

When the slot type die 1 is set in the direction of gravitational force (downward) with respect to the support medium at the start of coating or at the restart of coating, a discharge rate of the coating liquid is low and the position of the edge guides 2 is held at the same position as that during coating, the coating liquid flows down while oscillating from side to side in a comb shape from the discharge opening 17 of the slot type die 1. At this time, due to the coating liquid in the vicinity of the both ends of the discharge opening 17 of the slot type die 1 oscillating from side to side, the edge guides 2 or the flowing-down surface of supplemental water from the edge guides which is not illustrated may be contaminated in some cases.

Even when the coating liquid is not discharged, the coating liquid starts dropping by gravity at substantially constant intervals over the entire width thereof from the discharge opening 17 of the slot type die 1 with time. At this time, dropping of the coating liquid may be caused in the vicinity of the both ends of the discharge opening 17 as well. As a result, the edge guides 2 or the flowing-down surface of supplemental water (not shown) from the edge guides may be contaminated.

The positions to be spaced may be any one of the outer side in the coating width direction and the coating flow direction.

Specifically, FIG. 5 shows an example in which the edge guides are spaced from each other so that the distance between the edge guides is greater than the width of the discharge opening of the slot type die. Preferably, the right and left edge guides 2 and 2 are appropriately moved to the outer sides in the coating width direction more than the discharging width W of the discharge opening 17 of the slot die 1. For example, when the direction of discharging coating liquid from the slot type die 1 before the start of coating is set in the direction of gravitational force (downward) with respect of the support medium, the right and left edge guides are preferably moved to the outer sides in the coating width direction by approximately several millimeters to several tens of millimeters (R size). Also, in a state where the direction of discharging the coating liquid is kept in the horizontal direction or tilted from the horizontal direction in a direction distancing from the support medium, when the lip and slot of the slot die are cleaned and/or when the coating liquid in the manifold is replaced with air, they are moved thereto by several tens of millimeters or more. As a result, it is possible to solve the various problems such as coating loss associated with adhesion of the coating liquid of the edge guides 2.

At this time, because the edge guides 2 are separated from the discharge opening 17 of the slot die 1 in advance, it is possible to prevent contamination of the edge guides 2 or the flowing-down surface of supplemental water (not shown) from the edge guides.

At the stage at which an amount of supplying the coating liquid is increased to stop oscillation of the coating liquid, or to stop dropping of the coating liquid in a comb shape, by moving the edge guides 2 to the positions during coating, it is possible to prevent the coating liquid from contaminating the edge guides 2 or the flowing-down surface of supplemental water (not shown) from the edge guides.

The moving mechanism in the coating width direction of the edge guides 2 is preferably a unit separated from the slide mechanism of the edge guides 2 used for switching the coating width. In a case where the moving mechanism is used as the slide mechanism for switching the coating width as well, a required slide amount is preferably appropriately several millimeters to several tens of millimeters. In addition, although it takes a certain time to provide positioning points therefor or for a slide movement, a slide moving amount or slide moving positions may be a moving amount or moving positions for switching the coating width.

In the present invention, when at least one of the edge guides and the slot type die are movable in the direction gravitational force, and the direction of discharging coating liquid from the slot type die is set in the direction gravitational force, the top end of the flowing-down surface of the curtain film in edge guides and the leading end of the lip of the slot type die preferably contact each other.

The slot type die 1 and the edge guides 2 are preferably movable vertically.

When there is a clearance in the contacting surface of the slot type die 1 with the die lip 15, the coating liquid may intrude into the clearance, to contaminate the edge guides 2, which may bring about discontinuance of coating in the worst case.

In a case of a slot type curtain coating method, the edge guides 2 are movable in the coating width direction in accordance with a coating width. However, due to a slight backlash in the slide rail, a very small amount of clearance may be formed between the leading end of the die lip 15 of the slot type die 1 and the upper ends of the edge guides 2.

In the present invention, because the slot type die 1 or the pair of the edge guides 2 is made movable in the direction of gravitational force, it is possible to prevent emergence of the clearance, and it is possible to prevent contamination of the edge guides 2 or the flowing-down surface of supplemental water (not shown) from the edge guides due to the coating liquid flowing out.

The efficient strokes of the slot type die 1 or the pair of the edge guides 2 is preferably several millimeters.

A pressing force between the edge guides 2 and the die lip 15 of the slot type die 1 is not limited in particular as long as it is possible to eliminate the clearance, and it may be appropriately selected for any purpose. From the experiments conducted by the present inventors, as an up-and-down movable system for the edge guides 2, there is no clearance with the pressing force of 0.5 kg to 1.5 kg except for the weights of the edge guides 2 and the mounting brackets, that is favorable. The contact length with the die lip at this time is 45 mm and the contact width is 4.3 mm.

Figure 6:
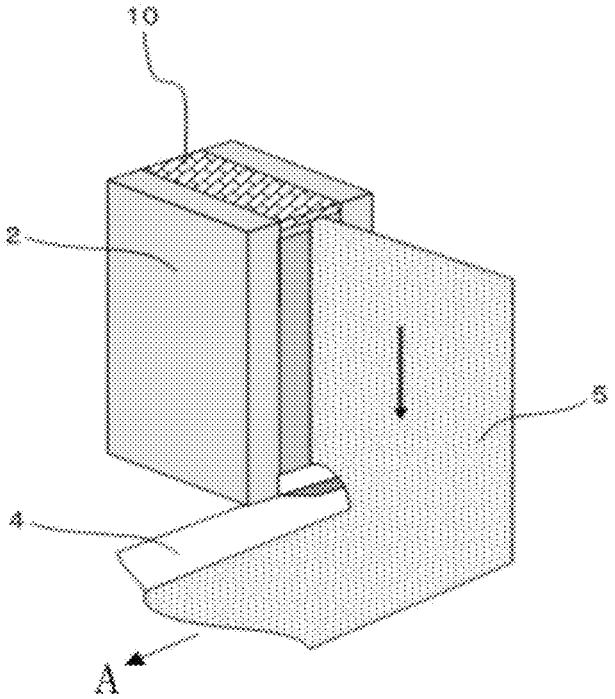
FIG. 6 is a partial enlarged view showing the contact portion of the edge guide with a die lip of the slot type die, where arrow A indicates a direction in which a web is conveyed.

As shown in FIG. 6, it is preferable to use a resin material 10 as the contact portion of the edge guide 2 with the die lip. In FIG. 6, reference numeral 4 denotes the support medium, and reference numeral 5 denotes the curtain film.

By using the resin material as a place of the top surface of the edge guide 2 contacting the die lip 15, it is possible to prevent occurrence of knocked scar on the surface of the die lip 15, and to prevent streaks and unevenness in the curtain film.

The resin material is not limited in particular, and it may be appropriately selected. For example, Teflon (registered trademark)-based resin, polypropylene-based resin or nylon-based resin may be given as an example.

As the resin material, a resin material which is not highly deformed by pressing between the discharge opening 17 of the slot type die 1 and the edge guides 2, and which is not dissolved in an organic solvent in a case of using an organic solvent-based coating liquid for coating is selected.

In the present invention, in order not to form a clearance between the discharge opening 17 of the slot type die 1 and the top surfaces of the edge guides 2, the slot type die 1 or the pair of the edge guides 2 is preferably movable in the direction of gravitational force. The linearity and the surface roughness of the die lip 15 are important in order to form the curtain film uniformly and with no streak and unevenness. As the slot type die 1 or the edge guide 2, stainless steel is usually used, and by vertically moving one of those to contact the other, the die lip 15 may have knocked scar thereon in some cases.

In the present invention, because the object is achieved by using a resin material softer than the die lip 15, in the case where hard stainless steel is used as a material of the die lip 15, soft metal such as aluminum may be used.

As a height of the slot type die, a preferable height differs according to contents of work. However, (1) as a height with respect to a worker, at the time of cleaning the manifold of the slot type die by using cleaning liquid, the height of the slot type die is preferably low, which is about a height of the elbows of the worker. This is because, presumably, the manifold is cleaned from the side of the die as well as the slot is cleaned from the front. Further, at the time of cleaning the die lip when only the coating liquid is discharged, the height of the slot type die may be either low or high. (2) As a height with respect to splashing of liquid, the height from the slot type die to the liquid receiving pan is low, which is preferably about 30 cm.

As described above, the height of the slot type die is preferably low, and the height from the slot type die to the liquid receiving pan is low, which is about 30 cm or less. However, it is about a height of the elbows of the worker.

When the rotating center of the slot type die is set to an appropriate height, it is possible to set the position of the lip low after the rotation. However, various limitations are imposed on designing the rotating center. Then, making the slot type die movable up and down can overcome the limitations on the design of the device.

Second Embodiment

Next, a second embodiment of a curtain coating method and a curtain coating device of the present invention will be described with reference to FIGS. 7, 8, 9, and 10.

Figure 7:
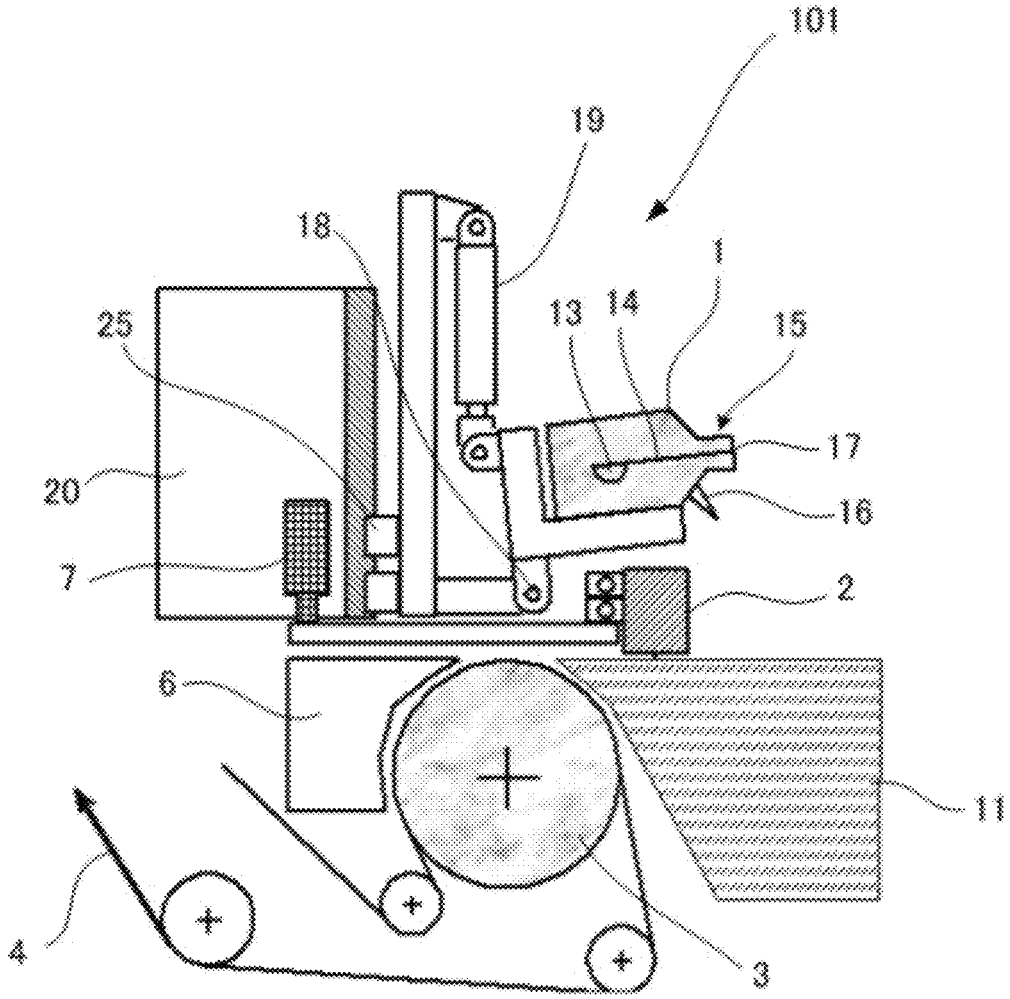
FIG. 7 is a side view showing another example of a slot type curtain coating device of the present invention.

FIG. 7 is a side view showing the second embodiment of a slot type curtain coating device 101 of the present invention. The curtain coating device 101 is composed of the slot type die 1, the edge guides 2, the backup roll 3, the support medium 4, the rotating center 18, and the rotational moment generating unit 19, where the rotating center 18 and the rotational moment generating unit 19 serve as a rotating unit.

In addition, in FIG. 7, respectively, reference numeral 6 denotes a vacuum chamber, reference numeral 7 denotes an edge guide elevating cylinder, reference numeral 8 denotes a back and forth slide unit, reference numeral 9 denotes a right and left slide unit, reference numeral 11 denotes a liquid receiving pan, reference numeral 12 denotes a die cleaning and air bubble removal pan, reference numeral 13 denotes a manifold, reference numeral 14 denotes a slot, reference numeral 15 denotes a die lip, reference numeral 16 denotes a liquid flowing-down guide plate, reference numeral 17 denotes a discharge opening, reference numeral 20 denotes a coating head frame, and reference numeral 21 denotes an edge guide spacing unit serving as a support member as well. In addition, the back and forth slide unit 8 and the right and left slide unit 9 are able to serve as spacing unit as well.

Figure 10:
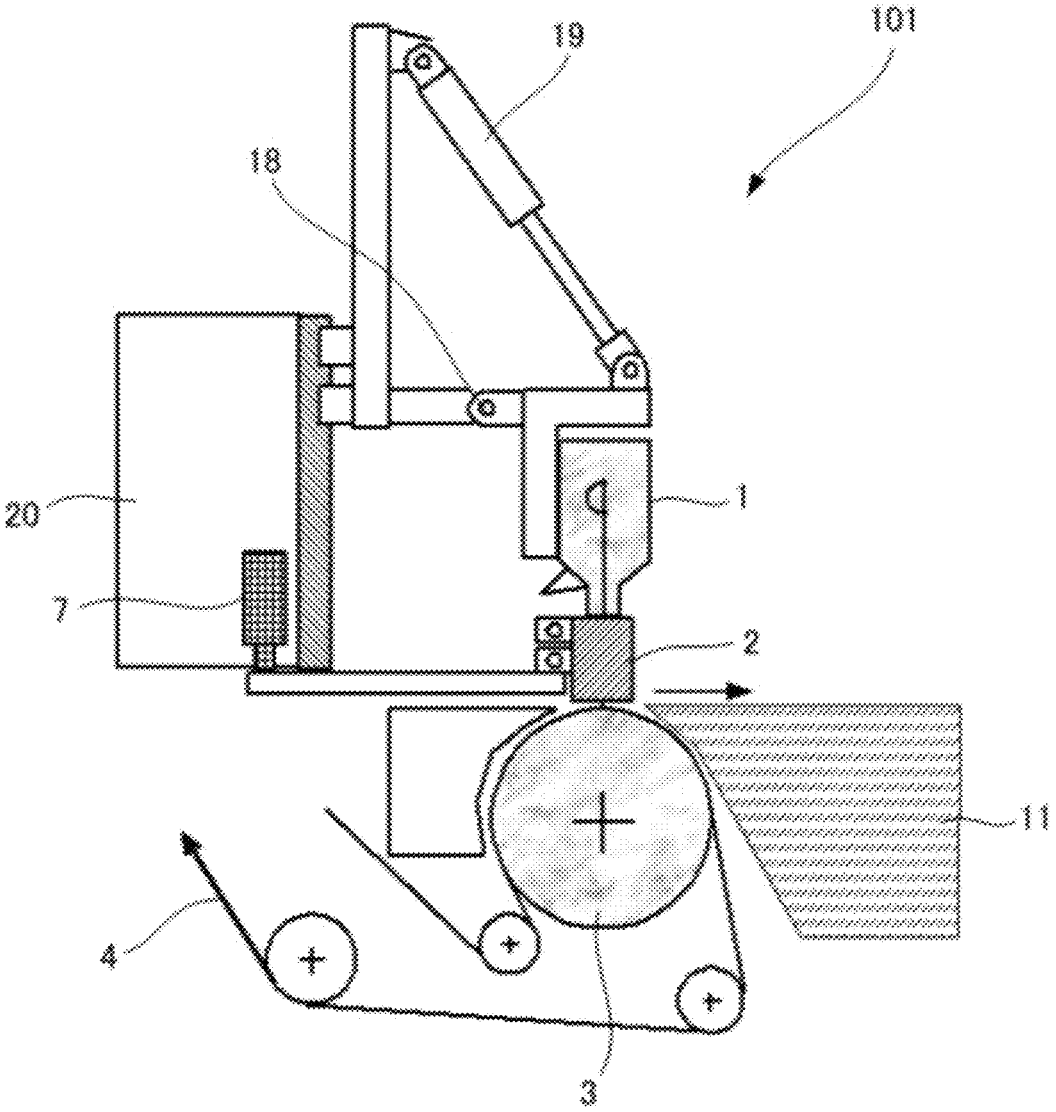
FIG. 10 is a diagram showing a relative positional relationship between the slot type die, the edge guides, and a backup roll during coating.

FIG. 10 shows a relative positional relationship between the slot type die 1, the edge guides 2, and the backup roll 3 during coating.

Figure 8:
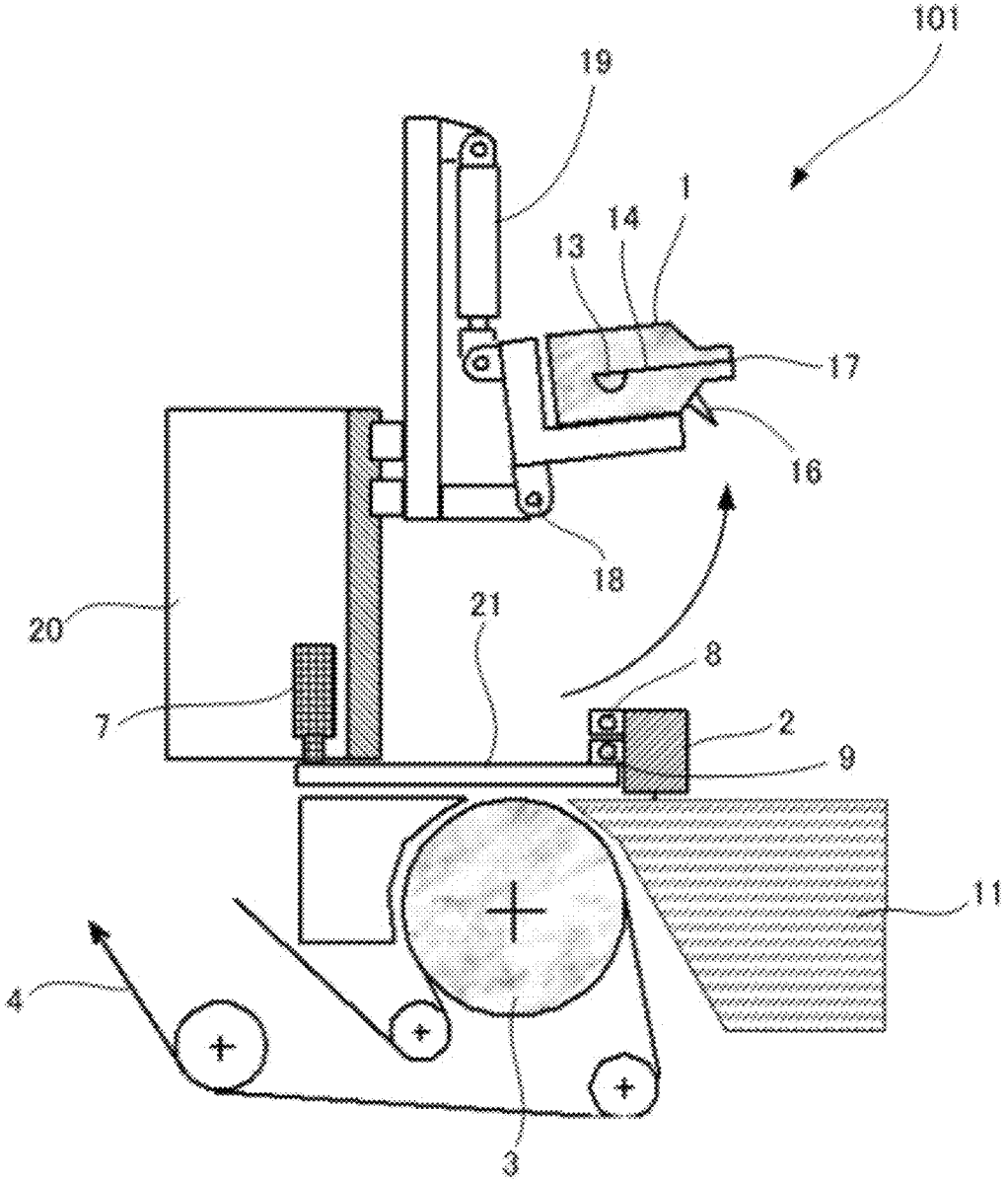
FIG. 8 is a side view showing the slot type curtain coating device during non-coating.
Figure 9:
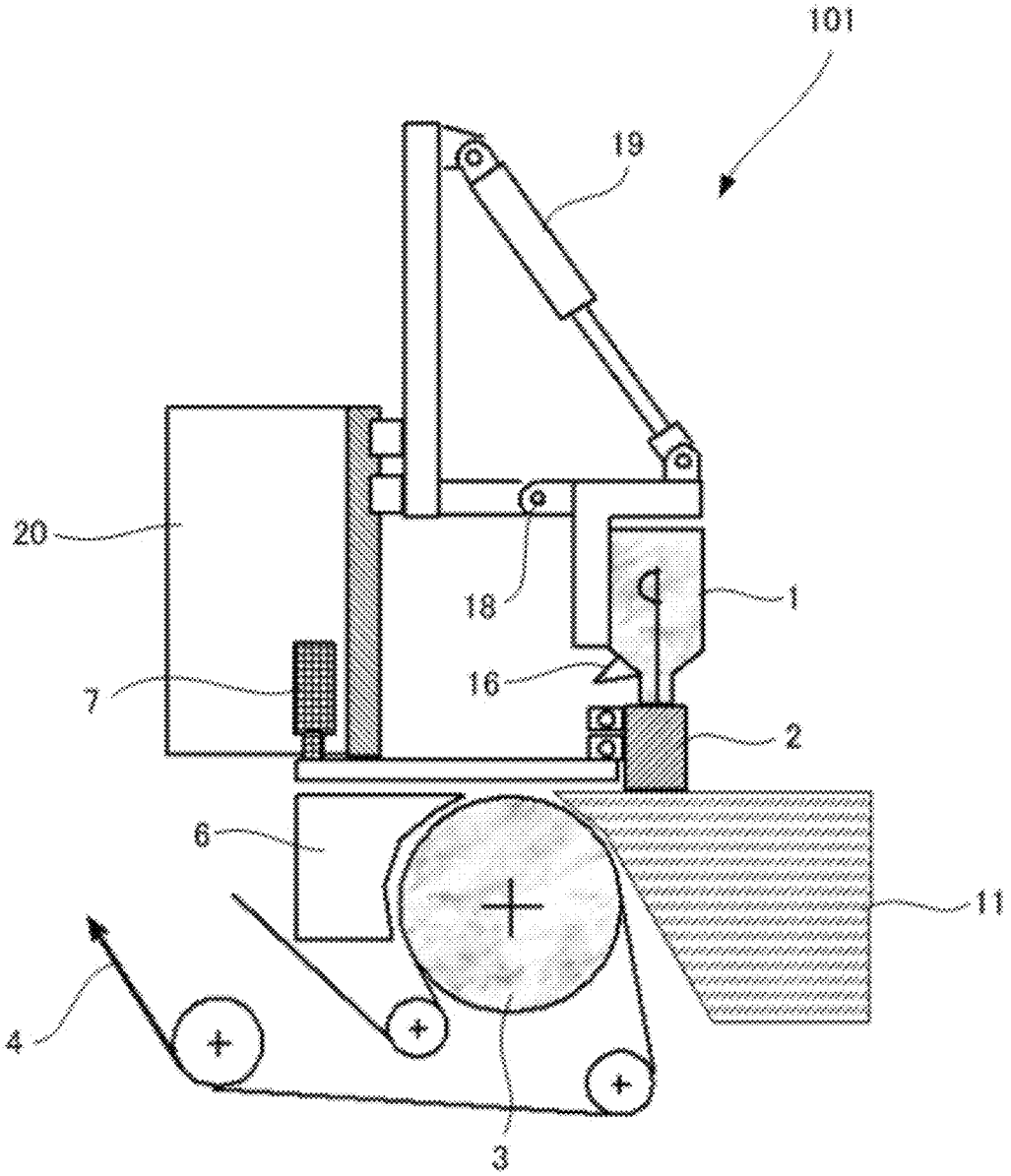
FIG. 9 is a side view showing the slot type curtain coating device at the end of coating.

After the end of coating, as shown in FIG. 9, the coating head frame 20 equipped with the slot type die 1 and the edge guides 2 moves, and the lot type die 1 and the edge guides 2 are located above the liquid receiving pan 11 from the position of the top of the backup roll 3. After an amount of supplying the coating liquid is made less to break the curtain film at this position, the slot type die 1 is rotated as soon as possible such that the direction in which the coating liquid is discharged from the slot type die 1 is kept the horizontal direction or tilted from the horizontal direction in the direction distancing from the support medium as shown in FIG. 8. Thereby, it is possible to prevent the air from intruding into the slot 14 and further into the manifold 13.

In a mass-production curtain coating device where the direction in which the coating liquid is to be discharged from the slot type die 1 is kept in the horizontal direction or tilted from the horizontal direction in the direction distancing from the support medium as shown in FIG. 8, when the distance between "the discharge opening of coating liquid from the die 1 or the liquid flowing-down guide plate 16 of the die" and "the bottom surface of the liquid receiving pan 11 or the liquid level in the liquid receiving pan 11" is large and when the coating liquid is discharged at the time of replacing the air in the manifold 13 by the coating liquid, the coating liquid drops to cause splashing of liquid, which may contaminate the surrounding area thereof.

In the experiments conducted by the present inventors, an acryl emulsion adhesive (viscosity characteristics: $y=900x^{0.26}$ (x denotes a shear rate (1/s), y denotes a viscosity and about 700 cp as measured with a B-type viscometer), and static surface tension: 30 dyn/s, product of Saiden Chemical Industry Co., Ltd.) was used to clean the die manifold, lip and slot. As a result, it was found that, regardless of the presence or absence of the liquid level in the liquid receiving pan, the splashing of liquid occurred when the distance between "the discharge opening of coating liquid from the die 1 or the liquid flowing-down guide plate 16 of the die" and "the bottom surface of the liquid receiving pan 11 or the liquid level in the liquid receiving pan 11" was 300 mm or more.

In the present invention, by moving the slot type die 1 in the direction of gravitational force (downward) as shown in FIG. 7 from the position of FIG. 8 while the direction in which the coating liquid is to be discharged from the slot type die 1 is kept in the horizontal direction or tilted from the horizontal direction in the direction distancing from the support medium, a distance between the discharge opening 17 of the slot type die 1 or the liquid flowing-down guide plate 16 of the slot type die, and the bottom surface of the liquid receiving pan 11 or the liquid level in the liquid receiving pan 11, i.e. a dropping height is made smaller, and although it differs depending on the viscosity of the coating liquid and the viscosity of the coating liquid in the liquid receiving pan 11, it possible to prevent contamination of the surrounding area thereof if it is set to 200 mm or less. In addition, in the embodiment shown in FIGS. 7 and 8, there is one liquid receiving pan different from those of FIG. 1, and there is no problem with only the liquid receiving pan 11.

When the rotating center of the slot type die is set to an appropriate height, it is possible to set the position of the lip low after the rotation. However, various limitations are imposed on designing the rotating center. Then, making the slot type die movable up and down can overcome the limitations on the design of the device.

Due to the coating head having such a structure, the height position of the slot type die 1 during non-coating, i.e., at the time of cleaning the die lip 15 or the time of exhausting air bubbles in the manifold 13 before the start of coating is further lowered, and it is easy to work, which enhances the workability, and improves the productivity. At this time, by setting the height position of the discharge opening of the die to about the height of the elbows of the worker, the arms of the worker are horizontal or downward when the worker inserts a reed-shaped film horizontally or downward and when the worker cleans the manifold from the side surface of the die. Therefore, it is possible to prevent contamination of any one of the arms and the clothes of the worker with the cleaning liquid or the cleaning waste liquid due to the cleaning liquid or the cleaning waste liquid flowing down along the arms of the worker.

Further, as the curtain coating device, the slot type die 1 and the edge guides 2 are equipped with a mechanism of temporarily evacuating those upward by approximately 0.5 mm to several mm by a slide mechanism 25 in order to prevent paper cutting by contact between the lower ends of the edge guides 2 and the paper splicer part (splice part) at the time of passing through a paper splicer part (splice part) during coating.

In the present invention, by building the moving mechanism for the positions of FIGS. 8, 9, and 10 and the position of FIG. 7 into the slide mechanism 25 used at the time of passing through the paper splicer part, the structure of the curtain coating device is essentially unchanged, and it suffices to extend a stroke of slide, and therefore, there is the advantage that the structure of the curtain coating device does not become complicated.

In the present invention, the coating liquid anti-scattering member is preferably disposed in front of the discharge opening 17 of the slot type die 1 when the direction in which the coating liquid is to be discharged from the slot type die 1 is kept in the horizontal direction or tilted from the horizontal direction in the direction distancing from the support medium (during non-coating). As shown in FIG. 7, at the time of replacing the air in the manifold 13 of the slot type die 1 by the coating liquid, contamination of the surrounding area with the coating liquid associated with spouting of air bubbles in unavoidable. In particular, an organic solvent is required in many cases for cleaning the contaminated portion in the case where the coating liquid is a pressure-sensitive adhesive, which is unfavorable in view of safety and sanitation.

In actuality, it is possible to suppress contamination of the surrounding area with the coating liquid associated with spouting of air bubbles by decreasing an amount of supplying the coating liquid to be supplied to the slot type die 1 at the time of replacing the air in the manifold 13 of the slot type die 1 by the coating liquid. However, it takes considerable time for replacing the air in reality, which results in a reduction in operating rate in a normal operation.

The slot 14 of the die lip 15 may be covered with a waste cloth to prevent scattering of the coating liquid until the end of replacing the air. In this case, because it is possible to reutilize the waste cloth to which the coating liquid adheres by washing the waste cloth, this is economical. In a case where the coating liquid is a pressure-sensitive adhesive, and is an acrylic pressure-sensitive adhesive in particular, it is impossible to remove the pressure-sensitive adhesive unless an organic solvent is used, that is unfavorable in view of safety and sanitation.

In addition, in a case of a disposable type waste cloth, there is no need to wash the waste cloth, which is uneconomical.

Further, it is possible to replace the air in the manifold 13 of the slot type die 1 by the coating liquid also by providing air-bleeding holes in the both ends of the manifold 13. In this case, shutoff valves are required at the same time of providing air-bleeding holes in the both ends of the manifold 13. Not only is the equipment cost increased in order to process the extremely expensive slot type die 1, but also the equipment structure becomes complicated, which is unfavorable.

Figure 12:
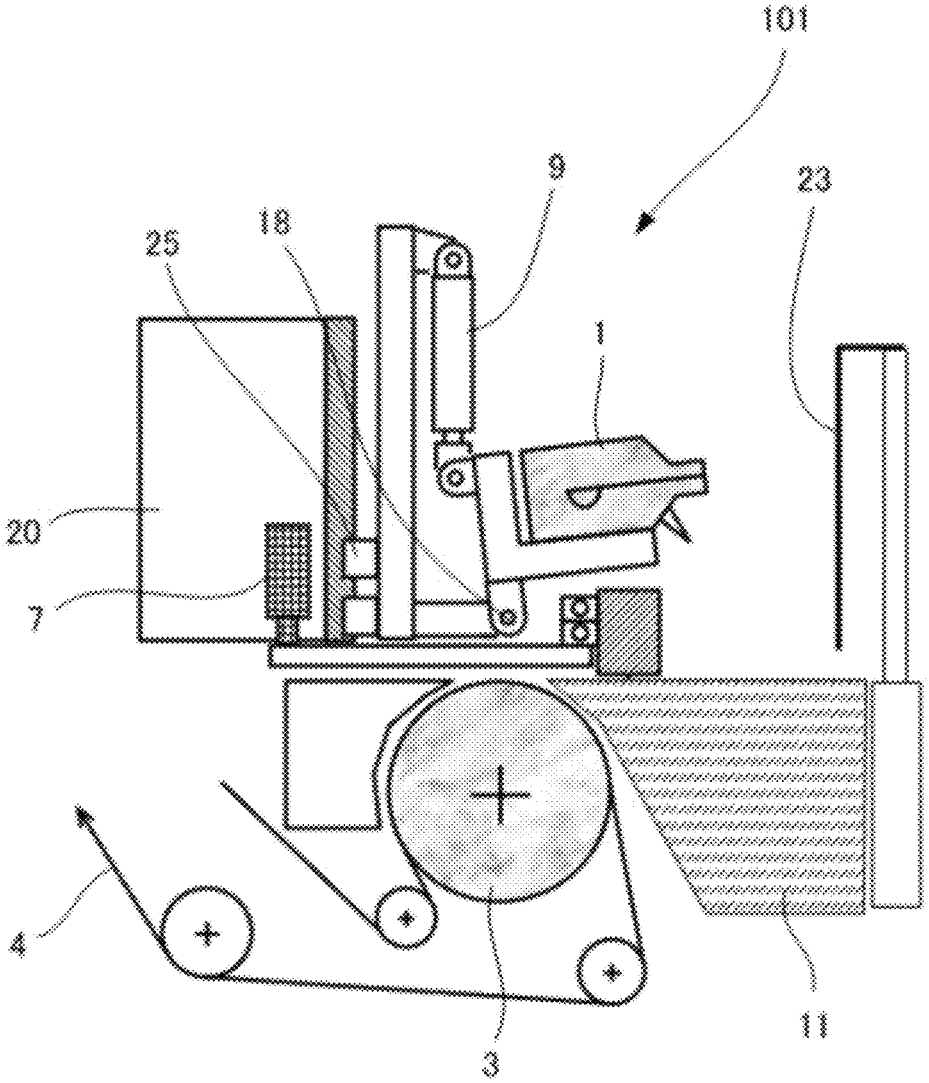
FIG. 12 is a side view showing an example of the slot type curtain coating device having an anti-scattering member.
Figure 13:
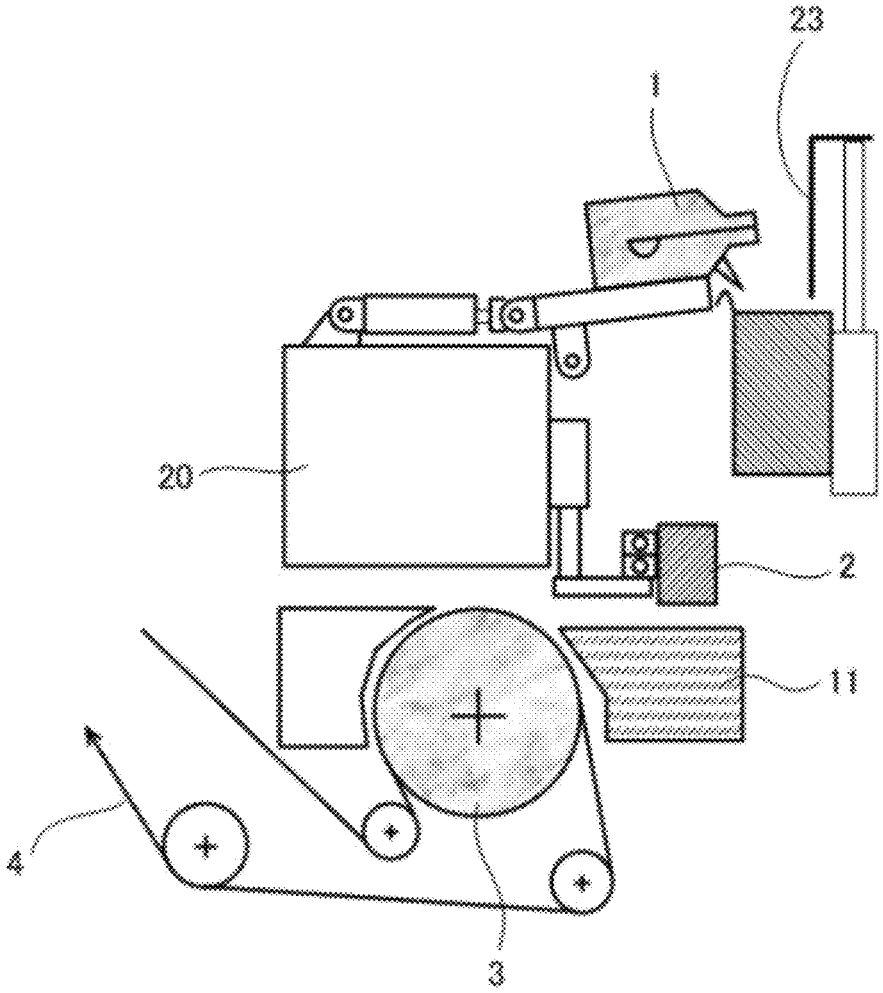
FIG. 13 is a side view showing another example of the slot type curtain coating device having an anti-scattering member.

In the present invention, even when there is spouting of the coating liquid associated with spouting of air bubbles, as shown in FIGS. 12 and 13, when the direction in which the coating liquid is to be discharged from the slot type die 1 is kept in the horizontal direction or tilted from the horizontal direction in the direction distancing from the support medium, a coating liquid anti-scattering member is disposed in front of the discharge opening of the die, thereby it is possible to prevent contamination of the surrounding area with the coating liquid due to the coating liquid smashing against the coating liquid anti-scattering member 23. In addition, it is efficient to provide the coating liquid anti-scattering member 23 to not only the front face, but also the side face in the direction of discharging coating liquid from the slot type die 1.

As the coating liquid anti-scattering member 23, for example, an anti-scattering plate, an anti-scattering sheet may be given as an example.

In the present invention, the lower end of the coating liquid anti-scattering member 23 or the vertical line of the lower end is preferably in the liquid receiving pan 11. Provided that the lower end of the coating liquid anti-scattering member 23 or the vertical line of the lower end is set in the liquid receiving pan 11, the coating liquid smashes against the coating liquid anti-scattering member 23 so as to be associated with spouting of air bubbles, and in FIG. 12, the coating liquid flows down along the coating liquid anti-scattering member 23 to be introduced into the liquid receiving pan 11, which makes it possible to prevent contamination of the surrounding area with the coating liquid.

In the slot die type curtain coating device which is capable of changing the direction of discharging coating liquid, although the weight of the slot type die 1 differs according to a maximum coating width, it is 300 kgf to 400 kgf, and the total weight including the support member of the slot type die 1 which is for being rotatable and the brackets around the rotating axis is around 500 kg, that is extremely heavy.

In such a slot die type curtain coating device, in some cases, the slot type die 1 may be rotated to drop rapidly due to malfunction of the applicator when the slot type die 1 is rotated to the direction of gravitational force (downward) with respect to the support medium from the position at which the direction in which the coating liquid is to be discharged from the slot type die 1 is kept in the horizontal direction or tilted from the horizontal direction in the direction distancing from the support medium, which has been a significant problem in view of ensuring safety of the equipment.

In the present invention, in addition to the rotating unit configured to change the direction in which the coating liquid is to be discharged from the slot type die (the rotating center 18 and the rotational moment generating unit 19), it is preferable to use a rotational moment adding unit 22 to always add, to the rotating unit, a rotational moment having a direction in which the slot type die 1 is rotated upward.

Figure 11:
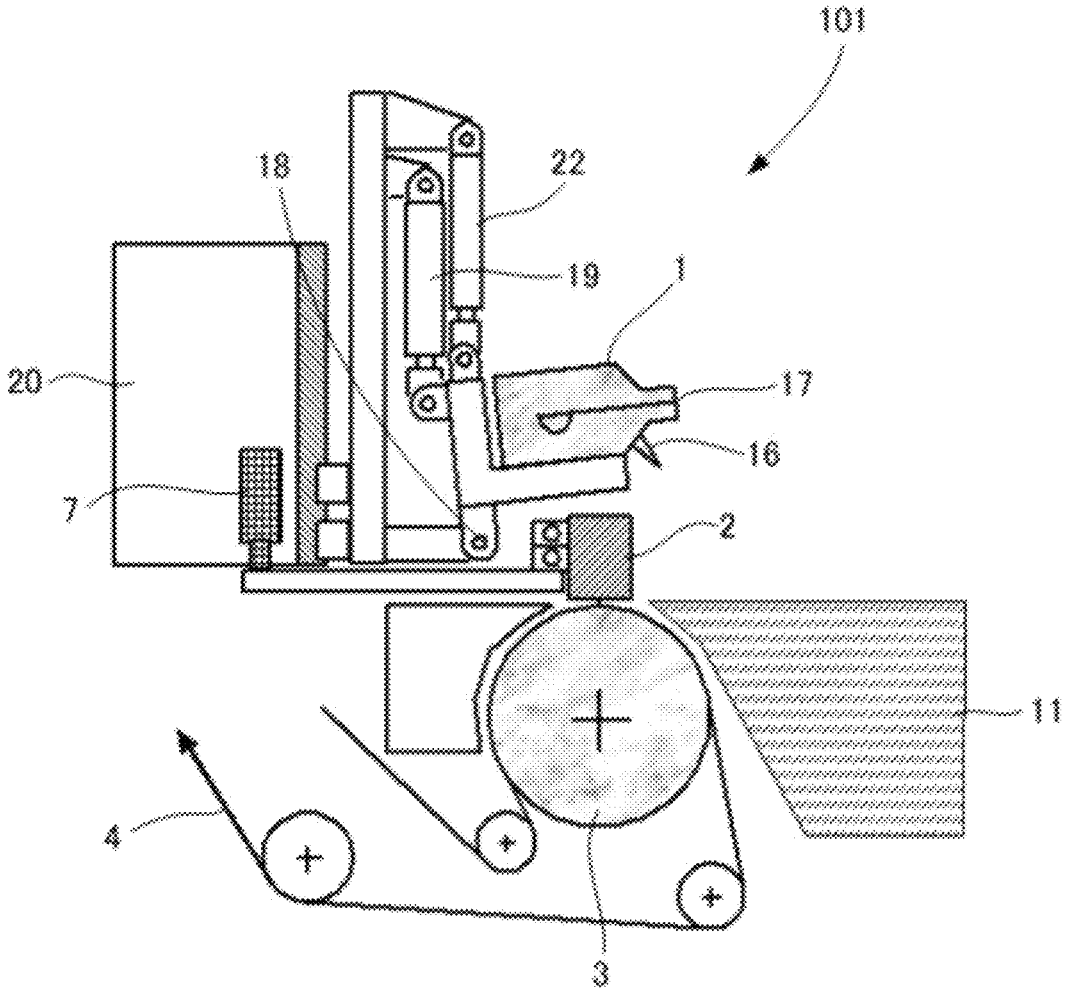
FIG. 11 is a side view showing an example of the slot type curtain coating device having rotating unit and rotational moment adding unit.

As shown in FIG. 11, when the rotational moment adding unit 22 is used, in addition to the rotating unit (the rotating center 18 and the rotational moment generating unit 19), to always add, to the rotational moment adding unit 22, a rotational moment that changes the direction in which the coating liquid is to be discharged from the slot type die 1 from the downward direction with respect to the support medium to the horizontal direction or the direction from the horizontal direction in the direction distancing from the support medium, the curtain coating device is improved in safety.

A method for adding a rotational moment by the rotational moment adding unit 22 is not limited in particular, and it may be appropriately selected for any purpose. For example, a combination of a link and a hydraulic cylinder, a combination of a link and a pneumatic cylinder, a combination of a link and an electric cylinder, a rack-and-pinion, a rotary oscillating actuator, a torsion bar, a coil spring, may be given as an example.

In the present invention, it is preferable to always add a rotational moment by an air cylinder. As shown in FIG. 11, by using a pneumatic cylinder as the rotational moment adding unit 22, it is possible to simply add a rotational moment in the opposing direction of the rotational moment in the flowing-down direction of the die 1 by the weight of the rotational part of the slot die type curtain coating device.

At this time, due to the circuit configured to supply compressed air to the pneumatic cylinder via a regulator with relief valve (not shown), when the direction in which the coating liquid is to be discharged is rotated to the direction of gravitational force (downward) from the position at which it is kept in the horizontal direction or tilted from the horizontal direction in the direction distancing from the support medium, it is possible to rotate it while exhausting the compressed air from the regulator with relief valve (not shown) by providing a rotational moment thereto by the rotating unit (the rotating center 18 and the rotational moment generating unit 19).

In a state where the direction in which the coating liquid is to be discharged from the slot type die is kept in the horizontal direction or tilted from the horizontal direction in the direction distancing from the support medium, it is preferable to have an anti-drop mechanism (not shown) in view of ensuring safety in order to prevent the slot type die from being rotated to drop to the direction of gravitational force (downward) for some reason.

The anti-drop mechanism is not limited in particular, and it may be appropriately selected. For example, a mechanical stopper which is a hydraulic cylinder or a pneumatic cylinder, a method for applying a pin preventing rotation to a bracket holding the rotating fulcrum may be given as an example.

Usually, in many cases, air bubbles are slightly contained in a coating liquid. In particular, it is extremely difficult to completely remove air bubbles in a coating liquid containing high-viscosity pressure-sensitive adhesive.

In the conventional slot type curtain coating device, the direction of discharging coating liquid from the slot type die 1 is in the direction of gravitational force (downward) with respect to the support medium, and it supplies the coating liquid to the manifold 13 of the die from the top surface of the slot type die 1 in many cases.

In such a method for supplying the coating liquid, when the slot type die 1 is rotated to be located at a position where the direction in which the coating liquid is to be discharged from the slot type die 1 is kept in the horizontal direction or tilted from the horizontal direction in the direction distancing from the support medium, the coating liquid is supplied upward or horizontally with respect to the slot type die 1, and therefore, air bubbles are less likely to be accumulated along the path of the liquid supply piping. However, because the coating liquid is supplied to the manifold of the die so as to be directed in the direction of gravitational force (downward) from the top surface of the slot type die, the air bubbles in the coating liquid are accumulated little by little in the liquid supply piping, and at one point, suddenly, large air bubbles flow out to bring about missing coating defects.

Figure 14:
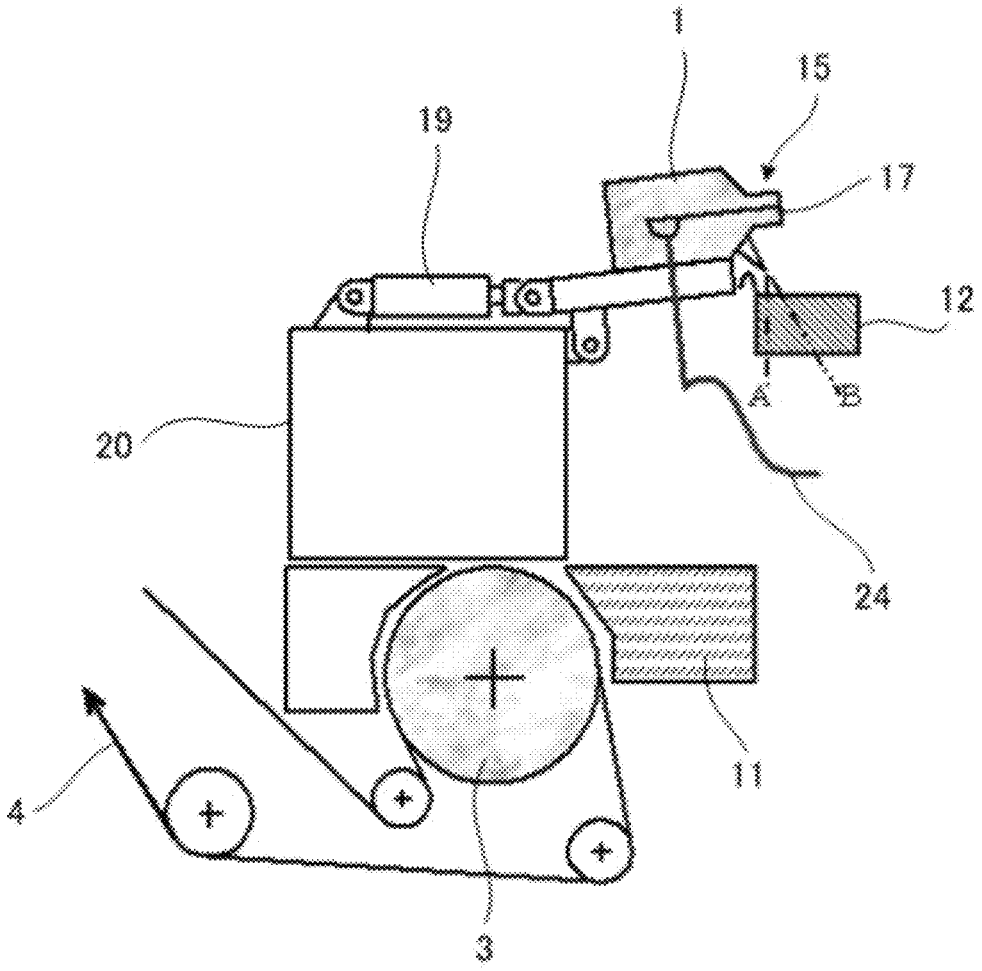
FIG. 14 is a side view showing an example of the slot type curtain coating device having liquid supply piping in a direction of gravitational force (downward) of the slot type die.
Figure 15:
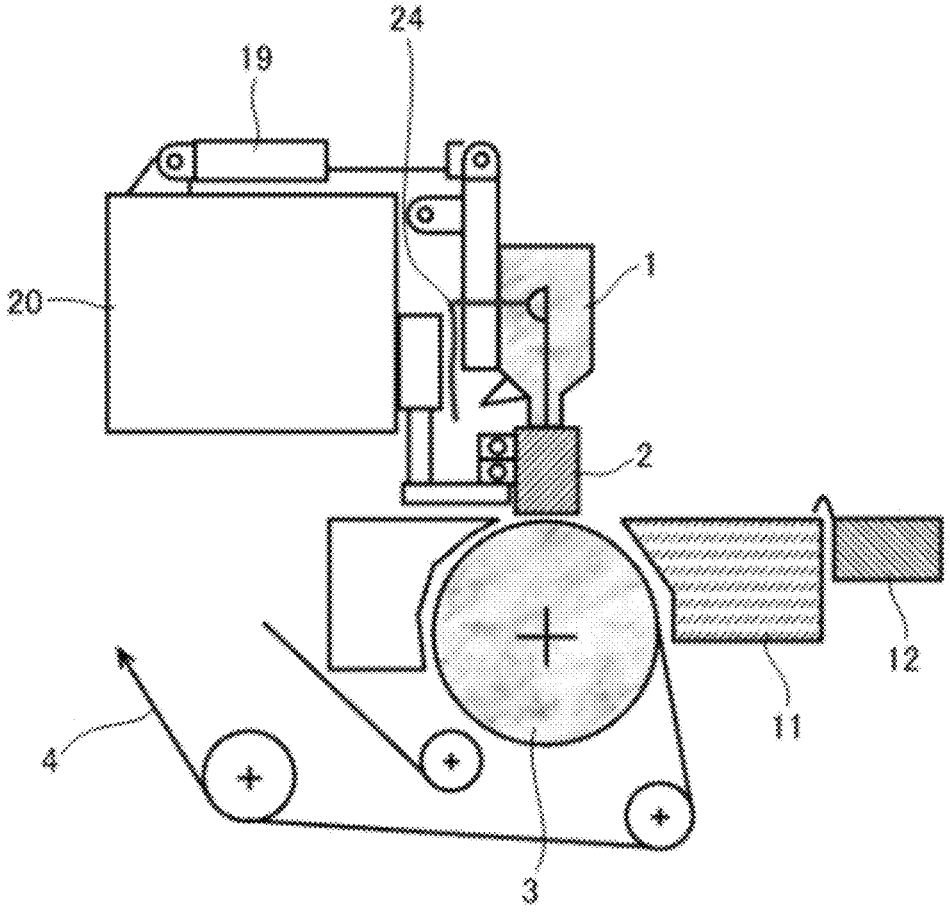
FIG. 15 is a side view showing another example of the slot type curtain coating device having liquid supply piping in the direction of gravitational force (downward) of the slot type die.

In the present invention, when the direction in which the coating liquid is discharged from the slot type die is kept in the horizontal direction or tilted from the horizontal direction in the direction distancing from the support medium, it is preferable to supply the coating liquid to the manifold from the lower side of the slot type die. As shown in FIGS. 14 and 15, in a state where the direction in which the coating liquid is to be discharged from the slot type die 1 is kept in the horizontal direction or tilted from the horizontal direction in the direction distancing from the support medium, by supplying the coating liquid through a liquid supply piping 24, which is orthogonal to the mating face of the slot type die 1 or the slot 14 surface inside the slot type die 1, from the lower side, air bubbles are not accumulated along the path of the liquid supply piping 24 in any case.

Further, even in the state in which the direction of discharging coating liquid from the slot type die 1 is set in the direction of gravitational force (downward) with respect to the support medium, the direction of supplying to the manifold 13 of the slot type die 1 is horizontal, and therefore, air bubbles are less likely to be accumulated along the path of the liquid supply piping 24, which makes it possible to suppress generation of missing coating defects.

The curtain coating method and the curtain coating device of the present invention have been described above in detail. The present invention is not limited to the above-described embodiments, and various modifications are permissible within the scope which does not deviate from the gist of the present invention.

Aspects of the present invention are as follows.

<1> A curtain coating method including:

discharging at least one coating liquid from a discharge opening of a slot type die;

forming a coating liquid film of the coating liquid freely falling; and applying the coating liquid film to a support medium continuously running, with both right and left ends of the coating liquid film being held by a pair of edge guides, wherein, during non-coating, a direction in which the coating liquid is to be discharged from the discharge opening of the slot type die is kept in a horizontal direction or tilted from the horizontal direction in a direction distancing from the support medium.

<2> The curtain coating method according to <1>, wherein the "during non-coating" is "before the start of coating," "during temporary suspension of coating" or "at the end of coating."

<3> The curtain coating method according to <1>, wherein the slot type die is rotated, so that the direction in which the coating liquid is to be discharged from the discharge opening of the slot type die is tilted at an angle of 0 degrees to 60 degrees with respect to the horizontal direction in the direction distancing from the support medium.

<4> The curtain coating method according to any one of <1> to <3>, wherein the slot type die is rotated integrally with or in synchronization with the edge guides, and the edge guides are moved from positions at which the edge guides are located during coating.

<5> The curtain coating method according to any one of <1> to <3>, wherein, during non-coating, the slot type die is rotated independently of the edge guides, and the edge guides are moved from positions at which the edge guides are located during coating.

<6> The curtain coating method according to any one of <1> to <3>, wherein when an amount of the coating liquid discharged from the slot type die is smaller than that in which the curtain film can be formed, the edge guides are moved from positions at which the edge guides are located during coating to positions other than a region where the coating liquid falls.

<7> The curtain coating method according to any one of <1> to <6>, wherein the slot type die is moved in a direction of gravitational force in a state where the direction in which the coating liquid is to be discharged from the discharge opening of the slot type die is kept in the horizontal direction or tilted from the horizontal direction in the direction distancing from the support medium.

<8> A curtain coating device including:

a slot type die containing a discharge opening from which at least one coating liquid is discharged to form a coating liquid film of the coating liquid freely falling;

a pair of edge guides which hold both right and left ends of the coating liquid film to be applied to a support medium continuously running, and a unit configured, during non-coating, to keep a direction in which the coating liquid is to be discharged from the discharge opening of the slot type die in a horizontal direction or to tilt the direction in which the coating liquid is to be discharged from the discharge opening of the slot type die from the horizontal direction in a direction distancing from the support medium.

<9> The curtain coating device according to <8>, wherein the "during non-coating" is "before the start of coating," "during temporary suspension of coating" or "at the end of coating."

<10> The curtain coating device according to <8> or <9>, wherein the direction in which the coating liquid is to be discharged from the slot type die is 0 degrees to 60 degrees with respect to the horizontal direction in the direction distancing from the support medium.

<11> The curtain coating device according to any one of <8> to <10>, further including: a moving unit configured to move the edge guides from positions at which the edge guides are located during coating.

<12> The curtain coating device according to any one of <8> to <11>, further including: a unit configured to move the slot type die in a direction of gravitational force in a state where the direction in which the coating liquid is to be discharged from the discharge opening of the slot type die is kept in the horizontal direction or tilted from the horizontal direction in the direction distancing from the support medium.

<13> The curtain coating device according to any one of <8> to <12>, further including: a die cleaning and air bubble removal pan, wherein the die cleaning and air bubble removal pan is located during non-coating in the vicinity of the discharge opening of the slot type die.

<14> The curtain coating device according to any one of <8> to <13>, further including: a liquid flowing-down guide plate, wherein the liquid flowing-down guide plate is located in the vicinity of a lip of the slot type die.

<15> The curtain coating device according to any one of <8> to <14>, further including: a coating liquid anti-scattering member, wherein the coating liquid anti-scattering member is located during non-coating at a position facing the discharge opening of the slot type die.

This application claims priority to Japanese application No. 2011-080197, filed on Mar. 31, 2011, and incorporated herein by reference.

What is claimed is:

1. A curtain coating method comprising:

discharging at least one coating liquid from a discharge opening of a slot type die;

forming a coating liquid film of the coating liquid freely falling; and applying the coating liquid film to a support medium continuously running, with both right and left ends of the coating liquid film being held by a pair of edge guides, wherein, during non-coating, the slot type die is rotated independently of the edge guides, and the edge guides are moved from respective positions at which the edge guides are located during coating, and wherein when an amount of the coating liquid discharged from the slot type die is smaller than that in which the curtain film can be formed, the edge guides are moved from positions at which the edge guides are located during coating to positions at which a distance between the edge guides is greater than a width of the discharge opening of the slot type die.

2. The curtain coating method according to claim 1, wherein the "during non-coating" is "before the start of coating," "during temporary suspension of coating" or "at the end of coating."

3. The curtain coating method according to claim 1, wherein the slot type die is rotated, so that a direction in which the coating liquid is to be discharged from the discharge opening of the slot type die is tilted at an angle of 0 degrees to 60 degrees with respect to a horizontal direction in a direction distancing from the support medium.

4. The curtain coating method according to claim 1, wherein the slot type die is moved in a direction of gravitational force in a state where a direction in which the coating liquid is to be discharged from the discharge opening of the slot type die is kept in a horizontal direction or tilted from the horizontal direction in a direction distancing from the support medium.

5. A curtain coating device comprising:

a slot type die containing a discharge opening from which at least one coating liquid is discharged to form a coating liquid film of the coating liquid freely falling;

a pair of edge guides which hold both right and left ends of the coating liquid film to be applied to a support medium continuously running;

an edge guide moving unit configured to move the edge guides from positions at which the edge guides are locating during coating, and during non-coating move the edge guides from positions at which the edge guides are located during coating; and a die moving unit configured to, during non-coating, rotate the slot type die independently of the edge guides, wherein when an amount of the coating liquid discharged from the slot type die is smaller than that in which a curtain film can be formed, the edge guide moving unit moves the edge guides from positions at which the edge guides are located during coating to positions at which a distance between the edge guides is greater than a width of the discharge opening of the slot type die.

6. The curtain coating device according to claim 5, wherein the "during non-coating" is "before the start of coating," "during temporary suspension of coating" or "at the end of coating."

7. The curtain coating device according to claim 5, wherein a direction in which the coating liquid is to be discharged from the slot type die is 0 degrees to 60 degrees with respect to a horizontal direction in a direction distancing from the support medium.

8. The curtain coating device according to claim 5, wherein the die moving unit moves the slot type die in a direction of gravitational force in a state where a direction in which the coating liquid is to be discharged from the discharge opening of the slot type die is kept in a horizontal direction or tilted from the horizontal direction in a direction distancing from the support medium.

9. The curtain coating device according to claim 5, further comprising: a die cleaning and air bubble removal pan, wherein the die cleaning and air bubble removal pan is located during non-coating in the vicinity of the discharge opening of the slot type die.

10. The curtain coating device according to claim 5, further comprising: a liquid flowing-down guide plate, wherein the liquid flowing-down guide plate is located in the vicinity of a lip of the slot type die.

11. The curtain coating device according to claim 5, further comprising: a coating liquid anti-scattering member, wherein the coating liquid anti-scattering member is located during non-coating at a position facing the discharge opening of the slot type die.

* * * * *